US006971870B2

(12) United States Patent
Sgroi, Jr. et al.

(10) Patent No.: US 6,971,870 B2
(45) **Date of Patent: *Dec. 6, 2005**

(54) MULTI-MODE LIGHTER

(75) Inventors: Anthony Sgroi, Jr., Wallingford, CT (US); Paul Adams, Monroe, CT (US)

(73) Assignee: BIC Corporation, Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/647,505

(22) Filed: Aug. 26, 2003

(65) Prior Publication Data

US 2004/0081931 A1 Apr. 29, 2004

Related U.S. Application Data

(63) Continuation-in-part of application No. 10/389,975, filed on Mar. 18, 2003, now Pat. No. 6,908,302, which is a continuation-in-part of application No. 10/085,045, filed on Mar. 1, 2002, now Pat. No. 6,726,469, which is a continuation-in-part of application No. 09/819,021, filed on Mar. 27, 2001, now Pat. No. 6,488,492, and a continuation-in-part of application No. 09/817,278, filed on Mar. 27, 2001, now Pat. No. 6,916,171, which is a continuation-in-part of application No. 09/704,689, filed on Nov. 3, 2000, now Pat. No. 6,491,515.

(51) Int. Cl.[7] ..... F23D 11/36
(52) U.S. Cl. ..... 431/153; 431/254
(58) Field of Search ..... 431/153, 254, 431/255

(56) References Cited

U.S. PATENT DOCUMENTS 2,498,377 A 2/1950 Nissen
3,758,820 A 9/1973 Lohberg
4,022,566 A 5/1977 Goto
4,259,059 A 3/1981 Roosa et al.
4,462,791 A 7/1984 Hayden
4,870,314 A 9/1989 Hefling
4,921,420 A 5/1990 Johnston
5,145,358 A 9/1992 Shike et al.
5,199,865 A 4/1993 Liang
5,262,697 A 11/1993 Meury
5,334,011 A 8/1994 Frigiére
5,462,432 A 10/1995 Kim
5,496,169 A 3/1996 Chen
5,520,197 A 5/1996 McDonough et al.
5,531,591 A 7/1996 Yamazaki
5,645,414 A 7/1997 Wang
5,697,775 A 12/1997 Saito et al.
5,854,530 A 12/1998 LaForest et al.
5,897,308 A 4/1999 Saito et al.
5,934,895 A 8/1999 McDonough et al.
5,971,751 A 10/1999 Lee
6,022,212 A 2/2000 Saito et al.
6,042,367 A 3/2000 Saito et al.
6,077,071 A 6/2000 Yeh (Continued)

*Primary Examiner*—Alfred Basichas

(74) *Attorney, Agent, or Firm*—Jones Day

(57) ABSTRACT

The present invention relates to a lighter comprising a housing having a supply of fuel, an actuating member movably associated with the housing to selectively perform at least one step in igniting the fuel, and a latch member slidably associated with the housing to selectively change the actuating member from a high-force mode to a low-force mode. The actuating member may be operable to perform the at least one step in igniting the fuel when in the high-force mode and when in the low-force mode. Various other features which improve the functioning of the lighter may be provided separately or in combination.

75 Claims, 31 Drawing Sheets

U.S. PATENT DOCUMENTS

| | | | | |
|---|---|---|---|---|
| 6,086,360 | A | 7/2000 | McDonough et al. | |
| 6,093,017 | A | 7/2000 | Saito et al. | |
| 6,146,129 | A | 11/2000 | Li | |
| 6,168,420 | B1 | 1/2001 | Sung | |
| 6,213,759 | B1 | 4/2001 | Sung | |
| 6,224,368 | B1 | 5/2001 | Chung | |
| 6,267,582 | B1 | 7/2001 | Lin | |
| 6,488,492 | B2 * | 12/2002 | Adams et al. | 431/153 |
| 6,491,515 | B1 * | 12/2002 | Tubby et al. | 431/153 |
| 6,726,469 | B2 * | 4/2004 | Adams et al. | 431/153 |
| 2002/0055076 | A1 * | 5/2002 | Adams et al. | 431/153 |
| 2002/0150852 | A1 | 10/2002 | Zhang | |
| 2004/0023178 | A1 * | 2/2004 | Sgroi et al. | 431/153 |
| 2004/0166453 | A1 * | 8/2004 | Adams et al. | 431/153 |

* cited by examiner

MULTI-MODE LIGHTER

CROSS-REFERENCE TO RELATED APPLICATIONS

The present application is a continuation-in-part of U.S. patent application Ser. No. 10/389,975, filed Mar. 18, 2003 now U.S. Pat. No. 6,908,302, which is a continuation-in-part of U.S. patent application Ser. No. 10/085,045, filed Mar. 1, 2002 now U.S. Pat. No. 6,726,469, which is a continuation-in-part of both U.S. patent application Ser. No. 09/817,278 now U.S. Pat. No. 6,916,171 and U.S. patent application Ser. No. 09/819,021 now U.S. Pat No. 6,488,492, both of which were filed on Mar. 27, 2001, and both of which are continuation-in-part applications of U.S. patent application Ser. No. 09/704,689, filed Nov. 3, 2000 now U.S. Pat. 6,491,515. The contents of these five applications are expressly incorporated herein by reference thereto.

TECHNICAL FIELD OF THE INVENTION

The present invention generally relates to lighters such as pocket lighters used to light cigarettes and cigars, or utility lighters used to ignite candles, barbecue grills, fireplaces and campfires, and more particularly to such lighters which resist inadvertent operation or undesirable operation by unintended users.

BACKGROUND OF THE INVENTION

Lighters used for igniting tobacco products, such as cigars, cigarettes, and pipes, have developed over a number of years. Typically, these lighters use either a rotary friction element or a piezoelectric element to generate a spark near a nozzle which emits fuel from a fuel container. Piezoelectric mechanisms have gained universal acceptance because they are simple to use. U.S. Pat. No. 5,262,697 ("the '697 patent") to Meury discloses one such piezoelectric mechanism, the disclosure of which is incorporated by reference herein in its entirety.

Lighters have also evolved from small cigarette or pocket lighters to several forms of extended or utility lighters. These utility lighters are more useful for general purposes, such as lighting candles, barbecue grills, fireplaces and campfires. Earlier attempts at such designs relied simply on extended actuating handles to house a typical pocket lighter at the end. U.S. Pat. Nos. 4,259,059 and 4,462,791 contain examples of this concept.

Many pocket and utility lighters have had some mechanism for resisting undesired operation of the lighter by young children. For example, pocket and utility lighters have included a spring-biased blocking latch which arrests or prevents movement of the actuator or push-button. U.S. Pat. No. 5,145,358 to Shike et al., disclose an example of such lighters.

There remains a need for lighters which resist inadvertent operation or undesirable operation by unintended users, but which provide each intended user with a consumer-friendly method of operating the lighters so that the lighters appeal to a variety of intended users.

SUMMARY OF THE INVENTION

The present invention is directed to a lighter comprising a housing having a supply of fuel, an actuating member movably associated with the housing to selectively perform at least one step in igniting the fuel, and a latch member slidably associated with the housing to selectively change the actuating member from a high-force mode to a low-force mode. When the actuating member is in the high-force mode, a first actuating force may be required to move the actuating member to perform the at least one step in igniting the fuel, and when the actuating member is in the low-force mode, a second actuating force may be required to move the actuating member to perform the at least one step in igniting the fuel, wherein the first actuating force is greater than the second actuating force. Preferably, the actuating member is operable to perform the at least one step in igniting the fuel when in the high-force mode and when in the low-force mode. The actuating member may be configured to be operable by a user's index finger and the latch member may be configured to be operable by a user's thumb.

According to one aspect of the invention, the latch member may be slidable along a surface of the housing. The actuating member may be movable in a first direction to perform the at least one step in igniting the fuel and the latch member may be slidable in a second direction to selectively change the actuating member from the high-force mode to the low-force mode. The first direction may be different than the second direction, substantially opposite the second direction, or substantially the same as the second direction.

According to another aspect of the invention, the actuating member may be movable along a first path in the first direction and the latch member may be slidable along a second path in the second direction. The first path may be substantially parallel to the second path, or alternatively, transverse to the second path. One or both of the first and second paths may be substantially linear. Additionally or alternatively, one or both of the first and second paths may be curved, arcuate, angled or extend along multiple axes.

According to yet another aspect of the invention, moving the actuating member a predetermined distance before sliding the latch member may increase the amount of force necessary to slide the latch member. Alternatively, moving the actuating member a predetermined distance before sliding the latch member may substantially prevent sliding of the latch member a sufficient distance to change the actuating member from the high-force mode to the low-force mode.

According to an alternative embodiment of the invention, a utility lighter may comprise a housing having a supply of fuel, an actuating member associated with the housing and movable along a first path to selectively perform at least one step in igniting the fuel, and a latch member associated with the housing and movable along a second path from a first position where the actuating member is in a high-force mode to a second position where the actuating member is in a low-force mode, wherein the first path is substantially parallel to the second path. The actuating member may move in a first direction along the first path and/or the latch member may move in a second direction along the second path.

According to yet another alternative embodiment of the invention, a lighter may comprise a housing having a supply of fuel, an actuating member movably associated with the housing to selectively ignite the fuel, and a latch member associated with the housing for selectively changing the actuating member from a high-force mode to a low-force mode, wherein the actuating member is movable in a first direction to ignite the fuel, the latch member is movable in a second direction to change the actuating member from the high-force mode to the low-force mode, and the first direction is substantially opposite the second direction. The actuating member may move along a first path and the latch member may move along a second path.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
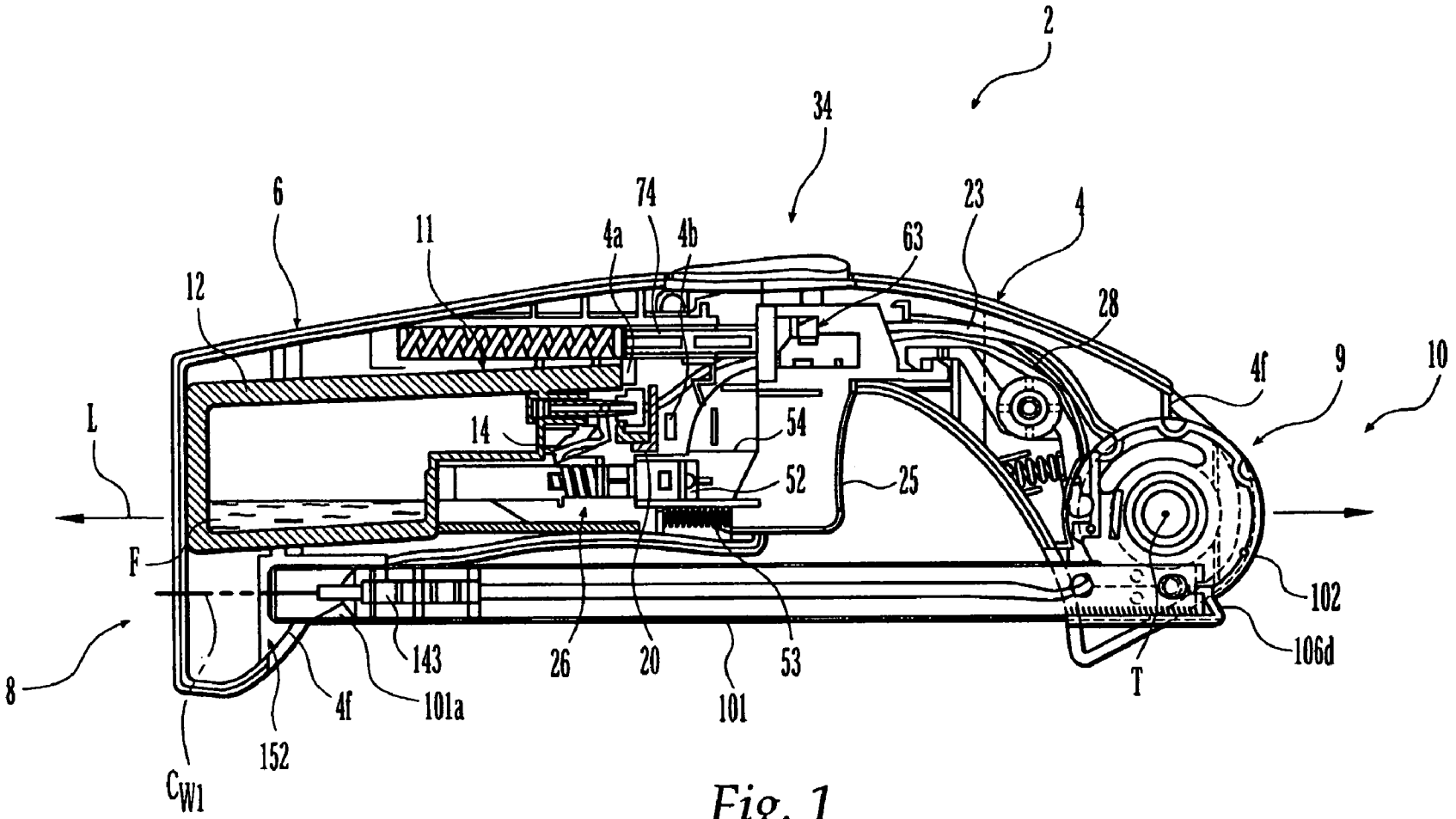
FIG. 1 is a cut-away, side view of a utility lighter according to one illustrative embodiment of the present invention, shown with various components removed for clarity and to better illustrate various inner details, wherein the lighter is in an initial state, a wand assembly is in a closed position, and a actuating member and latch member are in initial states, and a plunger member is in a high-actuation-force position.

Turning to FIG. 1, an embodiment of a utility lighter 2 constructed in accordance with the present invention is shown with the understanding that those of ordinary skill in the art will recognize many modifications and substitutions which may be made to various elements. While the invention will be described with reference to a utility lighter, one of ordinary skill in the art could readily adapt the teaching to conventional pocket lighters and the like.

Lighter 2 generally includes a housing 4 which may be formed primarily of molded-rigid-polymer or plastic materials such as acrylonitrile butadiene styrene terpolymer or the like. The housing 4 may also be formed of two-parts that are joined together by techniques known by those of ordinary skill in the art, such as ultrasonic welding.

Housing 4 includes various support members, such as support member 4*a* discussed below. Further support members are provided in the lighter 2 for various purposes, such as supporting components or directing the travel path of components. The housing 4 further includes a handle 6, which forms a first end 8 and a second end 9 of the housing. A wand assembly 10, as discussed in detail below, is pivotally connected to the second end 9 of the housing.

Figure 1A:
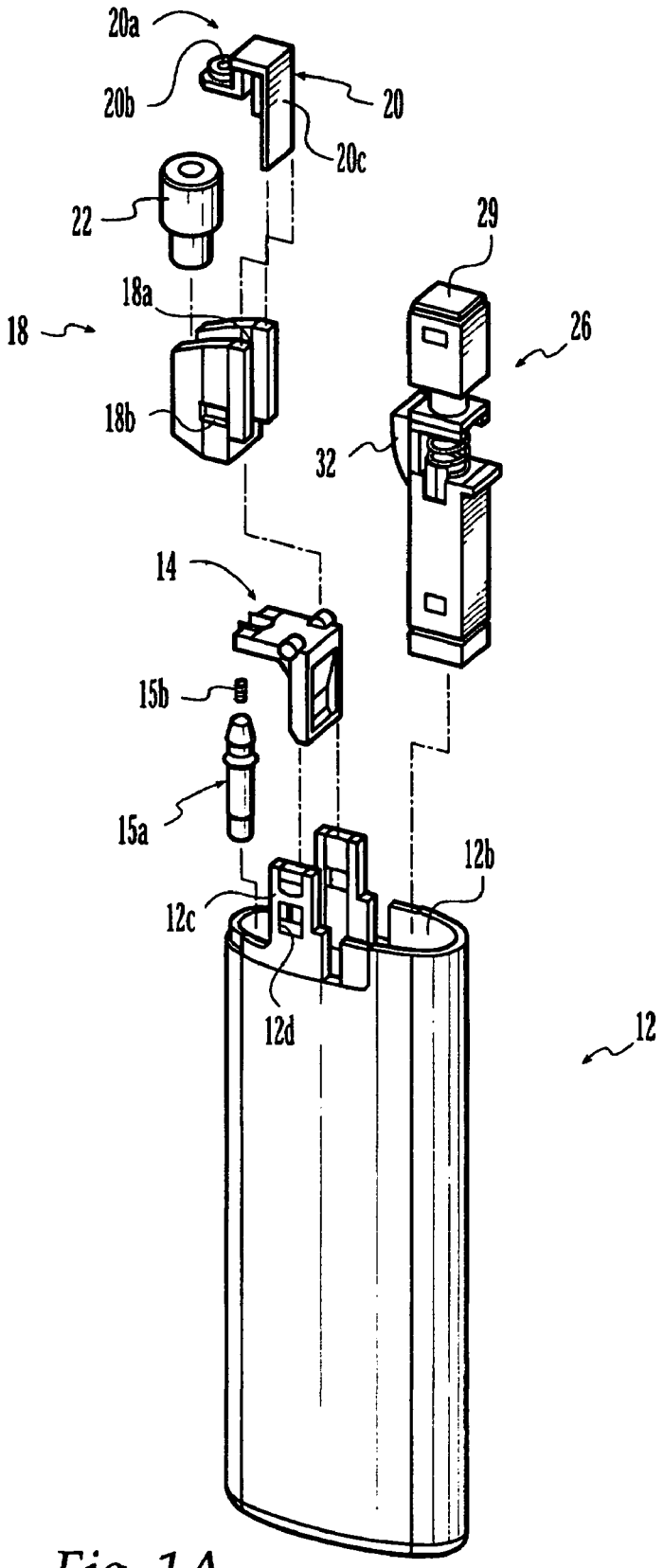
FIG. 1A is an enlarged, exploded, perspective view of several components of a fuel supply unit for use in the lighter of FIG. 1.
Figure 1B:
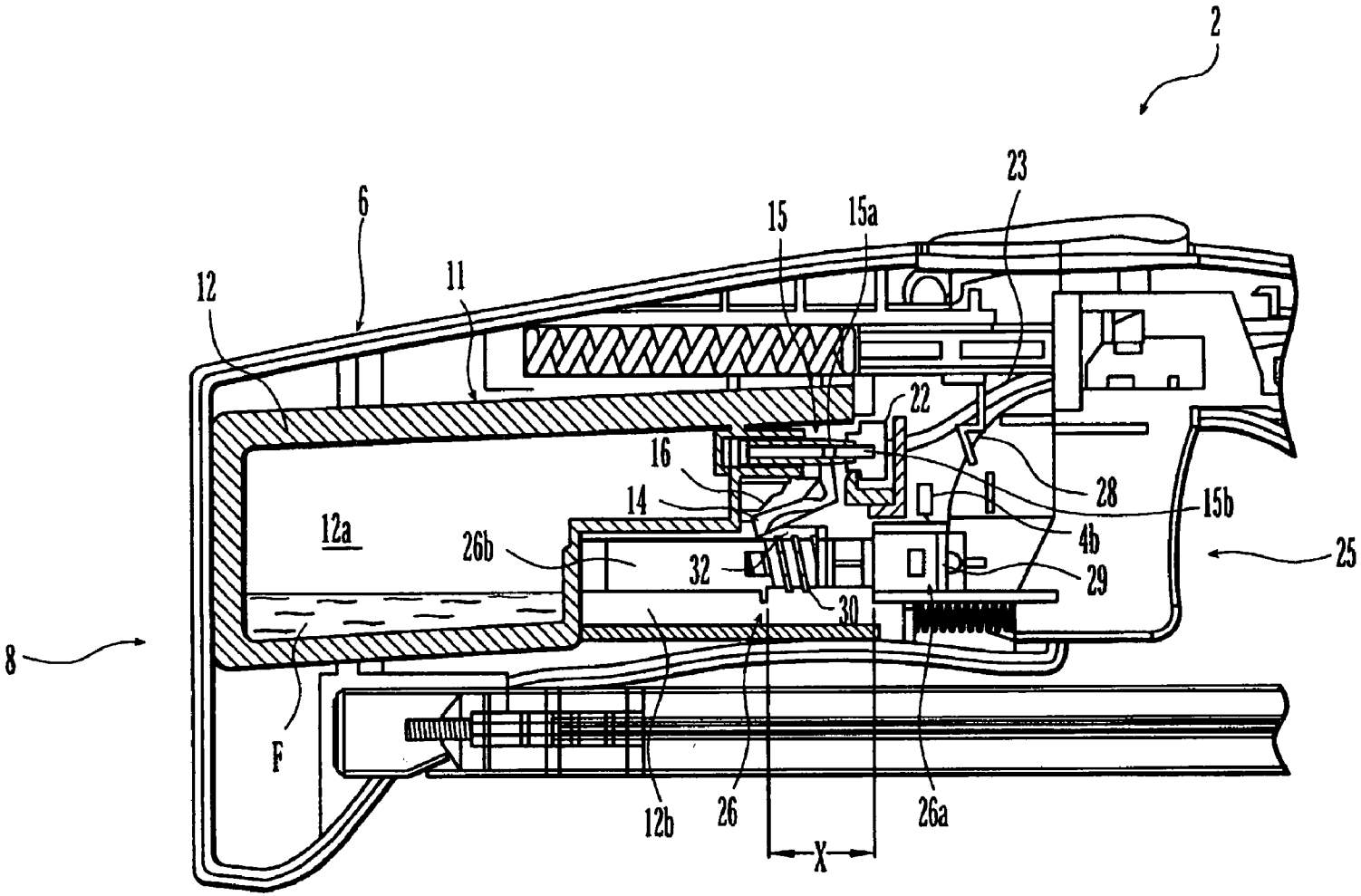
FIG. 1B is an enlarged, cut-away, side view of a rear portion of the utility lighter of FIG. 1.

Referring to FIGS. 1, 1A, and 1B, handle 6 preferably contains a fuel supply unit 11 that includes a fuel supply container or main body 12, a valve actuator 14, a jet and valve assembly 15, a spring 16, a guide 18, and a retainer 20. The container 12 supports the other components of the fuel supply unit 11 and defines a fuel compartment 12*a* and a chamber 12*b*, and further includes a pair of spaced support members 12*c* extending upward from the top edge thereof. The support members 12*c* define openings 12*d*. The fuel compartment 12*a* contains fuel F, which may be compressed hydrocarbon gas, such as butane or a propane and butane mixture, or the like.

Referring to FIGS. 1A and 1B, a valve actuator 14 is rotatably supported on the compartment 12 below the support members 12*c*. The valve actuator 14 is connected to a jet and valve assembly 15 that includes a jet or valve stem 15*a* and an electrode 15*b*. The electrode 15*b* is optional. The jet and valve assembly 15 is a normally open valve design, and closed by the pressure of a spring member 16 on valve actuator 14. Alternatively, a jet and valve assembly with a normally closed valve design can also be used.

A suitable fuel supply unit 11 is disclosed in U.S. Pat. No. 5,934,895 ("the '895 patent"), the disclosure of which is incorporated herein by reference in its entirety. An alternative arrangement for the fuel supply unit 11 that can be used is disclosed in U.S. Pat. No. 5,520,197 ("the '197 patent") or U.S. Pat. No. 5,435,719 ("the '719 patent"), the disclosures of which are incorporated by reference in their entirety. The fuel supply units disclosed in the above patents can be used with all of the disclosed components or with various components removed, such as windshields, latch springs, latches, and the like, as desired by one of ordinary skill in the art. Alternative arrangements of the fuel supply unit can be used.

Referring to FIG. 1A, the guide 18 with walls to define a slot 18*a* and projections 18*b*. When the lighter is assembled, the guide 18 is disposed between the support members 12*c*, and the support members 12*c* flex outward to accommodate the guide 18. Once the projections 18*b* are aligned with the openings 12*d*, the support members 12*c* may return to their vertical, initial positions. The interaction between the projections 18*b* and the openings 12*d* allow the guide 18 to be retained within the main body 12.

Referring to FIGS. 1A and 1B, the retainer 20 includes a front portion 20*a* that defines a bore 20*b* and a L-shaped rearward portion 20*c*. A fuel connector 22 is disposed on the top of jet 15*a* and receives a fuel conduit 23 therein. The connector 22, however, is optional and if not used the conduit 23 can be disposed on the jet 15*a* directly.

The retainer 20 properly positions fuel conduit 23 with respect to the jet and valve assembly 15 by receiving conduit 23 through the bore 20*b* so that the conduit 23 is within the connector 22. Details of the conduit 23 will be discussed below. The rearward portion 20*c* of the retainer 20 is disposed within the slot 18*a* of the guide 18. The retainer 20 and guide 18 may be configured so that these components snap-fit together so that the conduit 23 is properly positioned with respect to the jet and valve assembly 15. The guide 18 and retainer 20 are optional and the housing 4 or other components of the lighter can be used to support and position the connector 22 and the conduit 23. In addition, the guide and retainer 20 may be configured differently so long as they function to locate connector 22 and conduit 23 to jet 15*a*.

The container 12, guide 18, retainer 20, and connector 22 may be made with plastic material. However, the valve actuator 14, valve stem 15*a*, and electrode 15*b* are preferably formed of electrically conductive materials. The fuel supply unit 11 can be a preassembled unit that may include the fuel supply container 12, the jet and valve assembly 15, and the biased valve actuator 14. When the fuel supply unit 11 is disposed within the lighter, the housing support member 4*a* aids in locating and maintaining the position of the unit 11, as shown in FIG. 1. The housing support member 4*b* aids in positioning the retainer 20.

Referring again to FIG. 1, lighter 2 also includes an actuating member 25 which facilitates movement of the valve actuator 14 to selectively release fuel F. In this embodiment, the actuating member also selectively activates an ignition assembly 26 for igniting the fuel. Alternatively, the actuating member may perform either the fuel release or ignition function, and another mechanism or assembly may perform the other function. It is also possible for the actuating member to be part of an actuating assembly.

Referring to FIG. 1B, although not necessary for all aspects of this invention, an electric ignition assembly such as a piezoelectric mechanism is the preferred ignition assembly 26. The ignition assembly may alternatively include other electronic ignition components, such as shown in U.S. Pat. No. 3,758,820 and U.S. Pat. No. 5,496,169, a spark wheel and flint assembly or other well-known mechanisms in the art for generating a spark or igniting fuel. The ignition assembly may alternatively include a battery having, for example, a coil connected across its terminals. The piezoelectric mechanism may be the type disclosed in the '697 patent. Piezoelectric mechanism 26 has been illustrated in FIG. 1B schematically and particularly described in the '697 patent.

The piezoelectric unit 26 includes an upper portion 26*a* and a lower portion 26*b* that slide with respect to each other along a common axis. A coil spring or return spring 30 is positioned between the upper and lower portions 26*a*, 26*b* of piezoelectric unit. The return spring 30 serves to resist the compression of piezoelectric unit, and when positioned in the actuating member 25 resists the depression of actuating member 25. The lower portion 26*b* of piezoelectric unit is received in cooperating chamber 12*b* in fuel supply unit 11.

The piezoelectric unit 26 further includes an electrical contact or cam member 32 fixedly connected to the upper portion 26*a*. In the initial position, the portions 26*a, b* are separated by a gap X. The cam member 32 is formed of a conductive material. The upper portion 26*a* is coupled to actuating member 25. Spark conductor or wire 28 is partially insulated and may be electrically connected with the electrical contact 29 of the piezoelectric unit in any known manner.

Figure 2:
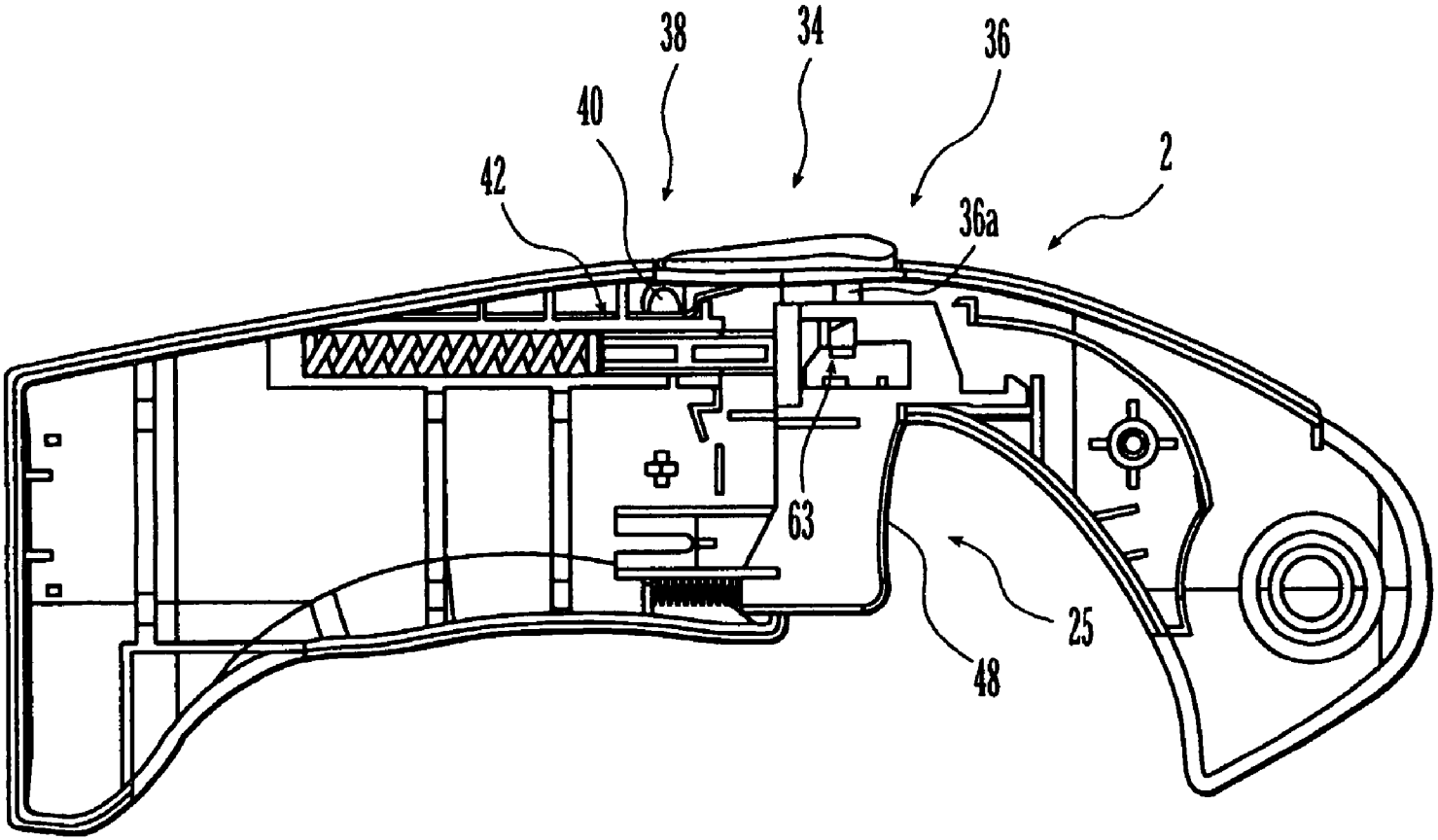
FIG. 2 is a partial, side view of the lighter of FIG. 1, shown with various components removed for clarity and to better illustrate various inner details such as a latch member, a plunger member and a biasing member, wherein the actuating member and latch member are in initial states, and the plunger member is in a high-actuation-force position.
Figure 3:
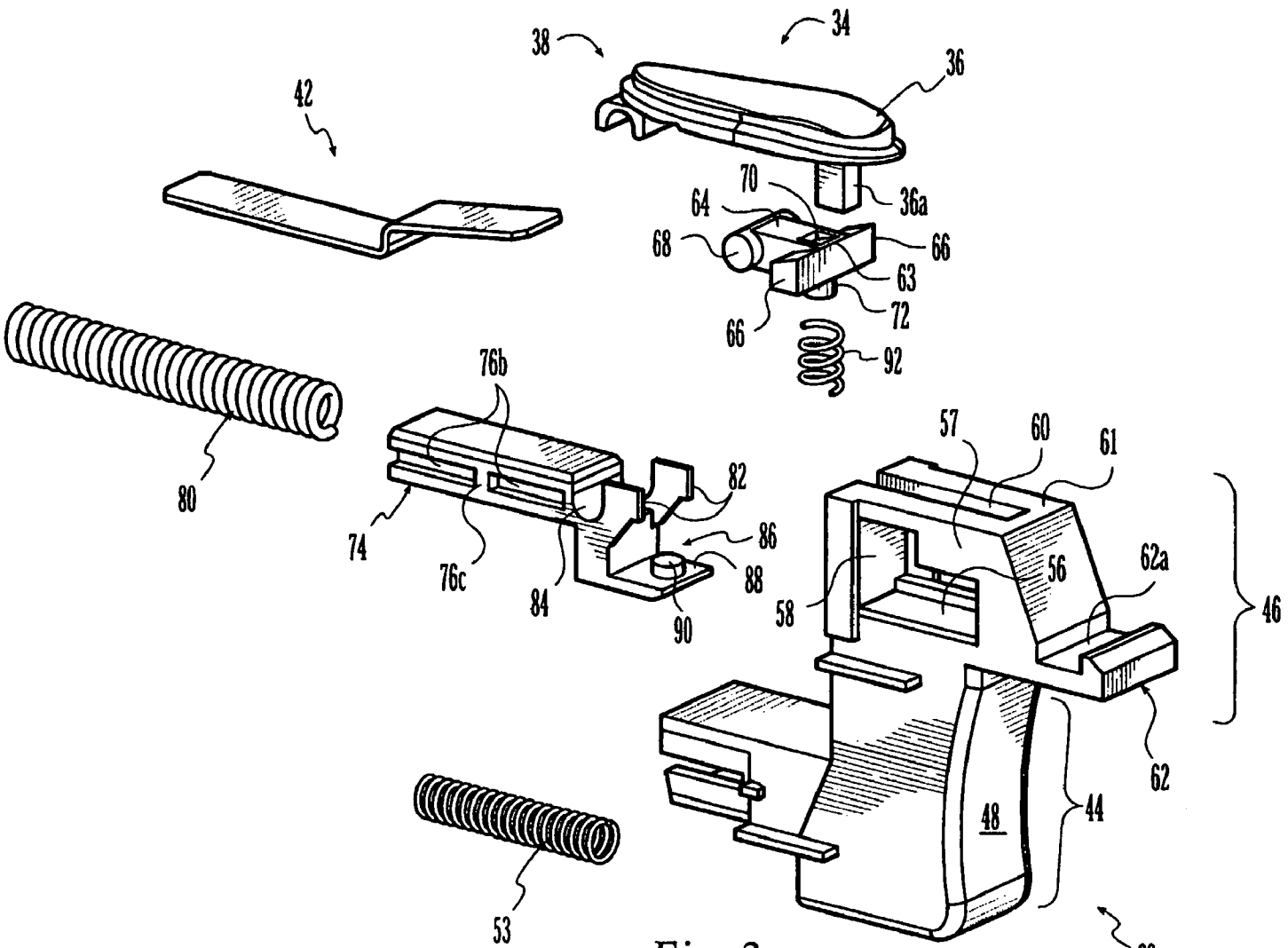
FIG. 3 is an enlarged, exploded, perspective view of various components of the lighter of FIG. 1, shown without a housing.
Figure 4:
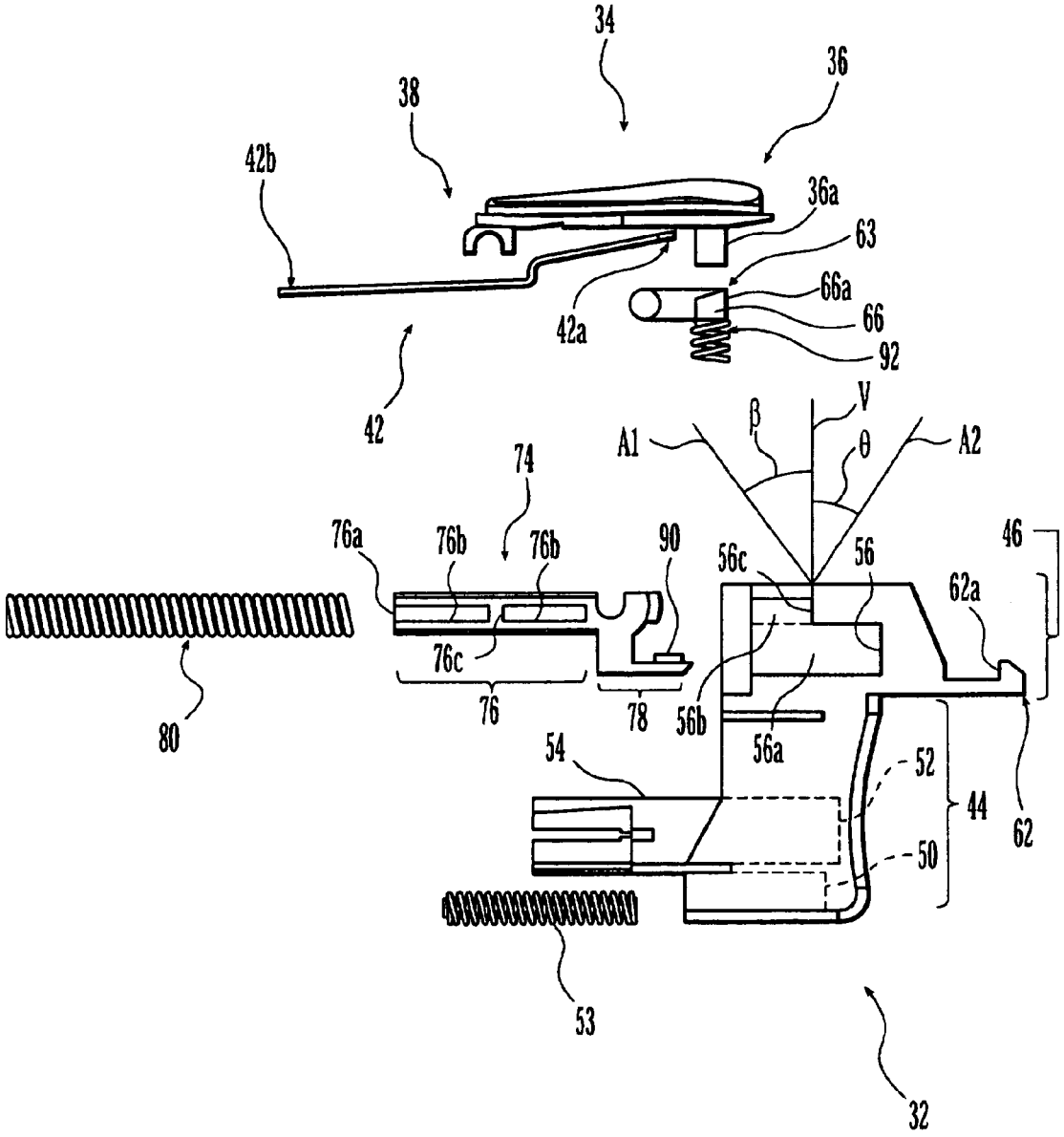
FIG. 4 is an enlarged, side view of the components of FIG. 3.

As shown in FIG. 1, latch member 34 is on the top side of the handle 6 and the actuating member 25 is opposite the latch member 34 near the bottom side of the handle 6. Referring to FIGS. 2–4, the latch member 34 generally includes an unsupported, movable, front end 36 which includes a downwardly extending boss 36*a* and a rear end 38 pivotally fixed to a hinge 40 of the housing 4. One of ordinary skill in the art can readily appreciate that latch member 34 also may be coupled to the housing in another manner such as in a cantilevered fashion, slidably or rotatably. When the latch member 34 is slidable a cam may be used therewith.

Referring to FIGS. 3 and 4, a leaf spring 42 includes a front end 42*a* and a rear end 42*b*. The leaf spring 42 is bent, as best seen in FIG. 4, so that the front end 42*a* is spaced above the rear end 42*b*. The shape of the leaf spring can be modified such as being planar depending on the arrangement of the components in the lighter and the necessary space considerations. Alternatively, the leaf spring may be disposed in front of latch member 34. In addition, the leaf spring may be replaced with a coil spring, a cantilever spring or any other biasing member suitable for biasing the latch member 34.

Figure 5:
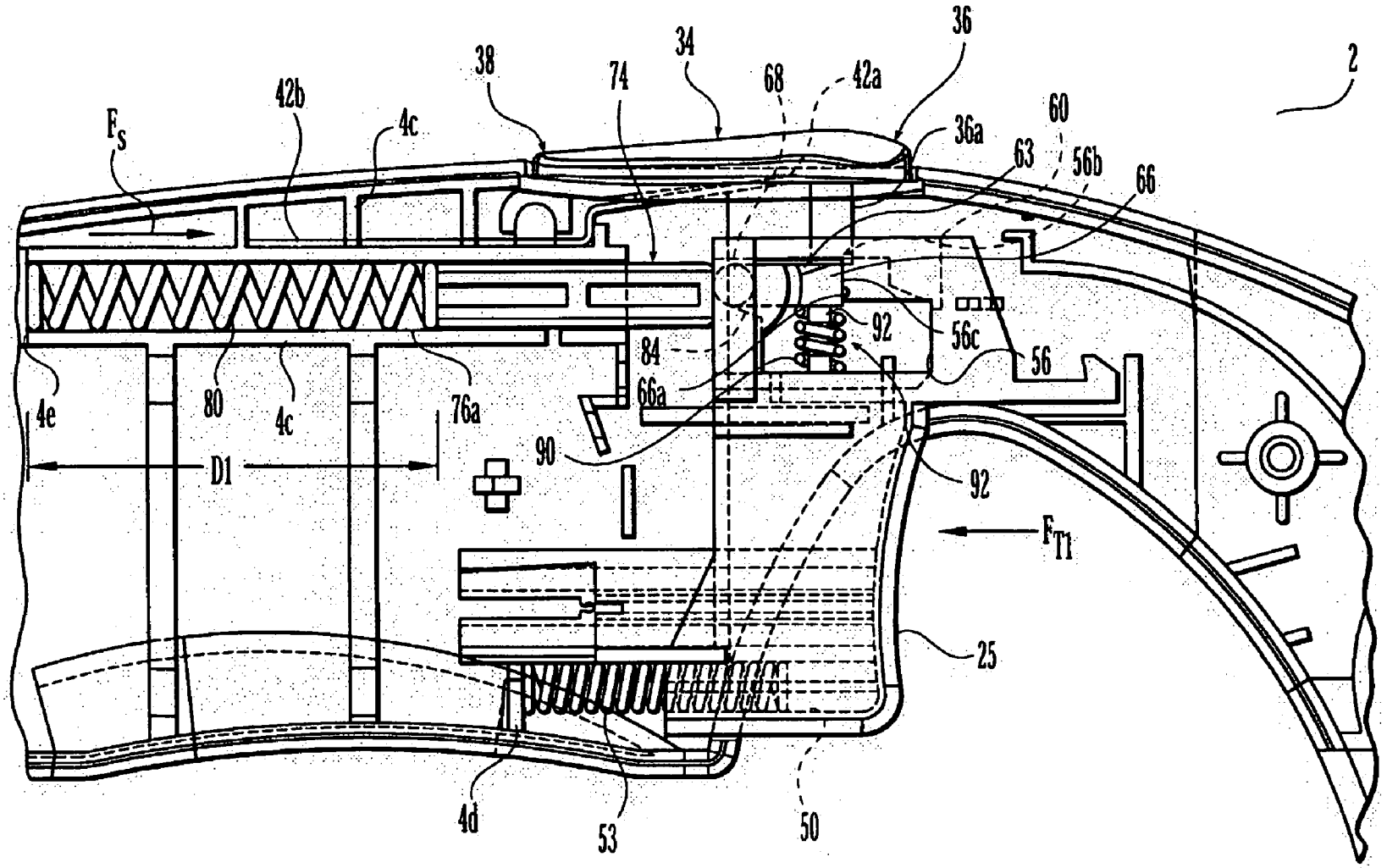
FIG. 5 is an enlarged, partial, side view of the lighter of FIG. 1, where the plunger member is in the high-actuation-force position and the actuating member is in an initial position.

Referring to FIG. 5, the rear end 42*b* of the leaf spring 42 is disposed within the housing 4 between support members 4*c* such that end 42*b* is coupled to the housing 4 such that spring 42 operates substantially like a cantilevered member. Due to the configuration, dimensions, and material of the spring 42, the front end 42*a* is free to move and is biased upward to return the latch member front end 36 to its initial position, as shown in FIG. 5. Thus, unsupported front end 36 of latch member 34 may be moved downwardly along with the front end 42*a* of spring 42.

Latch member 34 is preferably formed of plastic, while leaf spring 42 is preferably manufactured from a metal having resilient properties, such as spring steel, stainless steel, or from other types of materials. It should be noted that while leaf spring 42 is shown mounted to housing 4 it may alternatively be coupled to other components of the lighter.

Referring to FIG. 1, further details of the actuating member 25, will now be discussed. Actuating member 25 is preferably slidably coupled to housing 4. The actuating member 25 and housing 4 may be configured and dimensioned so that movement of the actuating member forward or rearward is limited. One of ordinary skill in the art can appreciate that the actuating member can alternatively be coupled or connected to the housing in another manner, such as in a pivotal, rotatable or cantilevered fashion. For example, the actuating member can be a linkage system or formed of two pieces, where one piece is slidably coupled to the housing and the other piece pivots.

Turning again to FIG. 3, the actuating member 25 includes a lower portion 44 and an upper portion 46. Referring to FIGS. 3–4, the lower portion 44 includes a forward finger actuation surface 48, a first chamber 50 (shown in phantom), and a second chamber 52 (shown in phantom). When the actuating member 25 is disposed within the housing 4, the finger actuation surface 48 extends from the housing so that it is accessible by a user's finger (not shown).

In this embodiment, the actuating member 25 lower and upper portions are formed as a single piece. Alternatively, the upper and lower portions can be two, separate pieces coupled together or the actuating member can be part of a multiple piece unit.

Referring to FIGS. 4 and 5, the first and second chambers 50 and 52 of the actuating member 25 are horizontally disposed. The first chamber 50 is below the second chamber 52, and the first chamber 50 is configured to receive an actuating member return spring 53. The spring 53 is disposed between the actuating member 25 and a first spring stop portion or support member 4*d* of the housing 4. Referring to FIG. 4, the actuating member 25 further includes an extension 54 extending rearwardly from the lower portion 44. The second chamber 52 extends into the extension 54. The second chamber 52 is configured to receive the ignition assembly 26 (as shown in FIG. 1).

Referring to FIGS. 3 and 4, the upper portion 46 of the actuating member 25 includes two L-shaped guides. In this embodiment the guides are side cutouts, represented by cutout 56, in side wall 57. The cutout 56 includes a first portion 56*a* and a second portion 56*b* in communication with the first portion 56*a*. The second portion 56*b* includes a wall 56*c* substantially parallel to vertical axis V. Vertical axis V is perpendicular to longitudinal axis L and transverse axis T (shown in FIG. 1). In this embodiment, the guides are cutouts but in another embodiment the actuating member can have solid side walls and the guides can be formed on the inner surface of the side walls.

Referring to FIG. 3, the upper portion 46 of the actuating member also includes a rear cutout 58 and slot 60 in an upper wall 61 of the actuating member. The upper portion 46 further includes a forwardly extending engaging portion 62 with an engaging surface 62*a*. The function of the engaging portion 62 will be discussed in detail below.

Referring to FIGS. 1 and 3, in this embodiment the upper portion 46 of the actuating member 25 and the guides 56 form a portion of a dual-mode assembly. The dual-mode assembly also includes a plunger member 63 and a piston member 74. In this embodiment, the lower and upper portions 44 and 46 of the actuating member are formed as a single piece. In another embodiment, the lower and upper portions 44 and 46 can be formed as separate pieces and operatively connected together.

The plunger member 63 when installed in the lighter is disposed below the latch member 34. The plunger member 63 is substantially T-shaped with a longitudinally extending body portion 64 and transversely extending head portions 66. As best seen in FIG. 4, the head portions 66 have a planar, front surface 66*a*. Surface 66*a* is generally parallel to vertical axis V, when plunger member 63 is installed within actuating member 25.

Referring again to FIG. 3, the body portion 64 includes two transversely extending pins 68 at the rear end, a recess 70 on the upper surface, and a vertically extending projection 72 that extends from the bottom surface of the body portion 64. Recess 70 is optional.

Referring to FIGS. 3 and 4, in alternative embodiments, the wall 56*c* of the actuating member 25 and the wall 66*a* of the plunger member 63 can be configured differently. For example, walls may alternatively be angled with respect to vertical axis V. For example, walls 66*a* and 56*c* may be angled to be substantially parallel to line A1, which is angularly offset from vertical axis V by angle $\beta$. Walls 66*a*, 56*c* may alternatively be angled to be substantially parallel to line A2, which is angularly offset from vertical axis V by angle $\theta$. Alternatively, wall 56*c* can be configured to include a V-shaped notch and the wall 66*a* can include a V-shaped projection to be received in notch of wall 56*c* or vice versa.

Referring to FIGS. 4 and 5, the piston member 74 includes a rear portion 76 and a front portion 78. The rear portion 76 includes a vertical rear wall 76*a* for contacting a high-force spring or biasing member 80. The spring 80 is disposed between the wall 76*a* and the second spring stop portion or support member 4*e* of the housing 4. Turning again to FIG. 4, the rear portion 76 further includes horizontal cutouts 76*b* that define a stop member 76*c*. The cutouts 76*b* and stop member 76*c* allow the piston member 74 to be slidably mounted to rails (not shown) in the housing and to allow the piston member 74 to slide longitudinally a predetermined distance so that the plunger member 63 can function as discussed below.

Referring to FIGS. 3 and 4, the front portion 78 of the piston member 74 includes two spaced apart arms 82. The arms 82 and front portion 78 define a cutout 84 that receives the pins 68 of the plunger member 63. The cutout 84 and pins 68 of the plunger member 63 are configured and dimensioned to allow the plunger member 63 to pivot with respect to the piston member 74, as discussed in detail below. In this embodiment, the plunger member 63 is pivotally connected to the piston member 74, however in another embodiment the plunger member 63 can be fixedly connected to the piston member 74 but be a resiliently deformable.

The front portion 78 of piston member 74 further includes a downwardly extending support portion 86 that includes a horizontal platform 88 with an upwardly extending pin 90. Referring to FIGS. 3 and 5, when the piston member 74 is assembled within the lighter, the platform 88 is disposed through the rear cutout 58 of actuating member 25, and the pin 90 may be aligned with the pin 72 of the plunger member 63 so that the pins 72, 90 retain a plunger return spring 92 there between. The plunger member 63 contacts the bottom surface of upper wall 61 (as shown in FIG. 3) due to the return spring 92 that biases the plunger member upward toward an initial position.

Figure 3A:
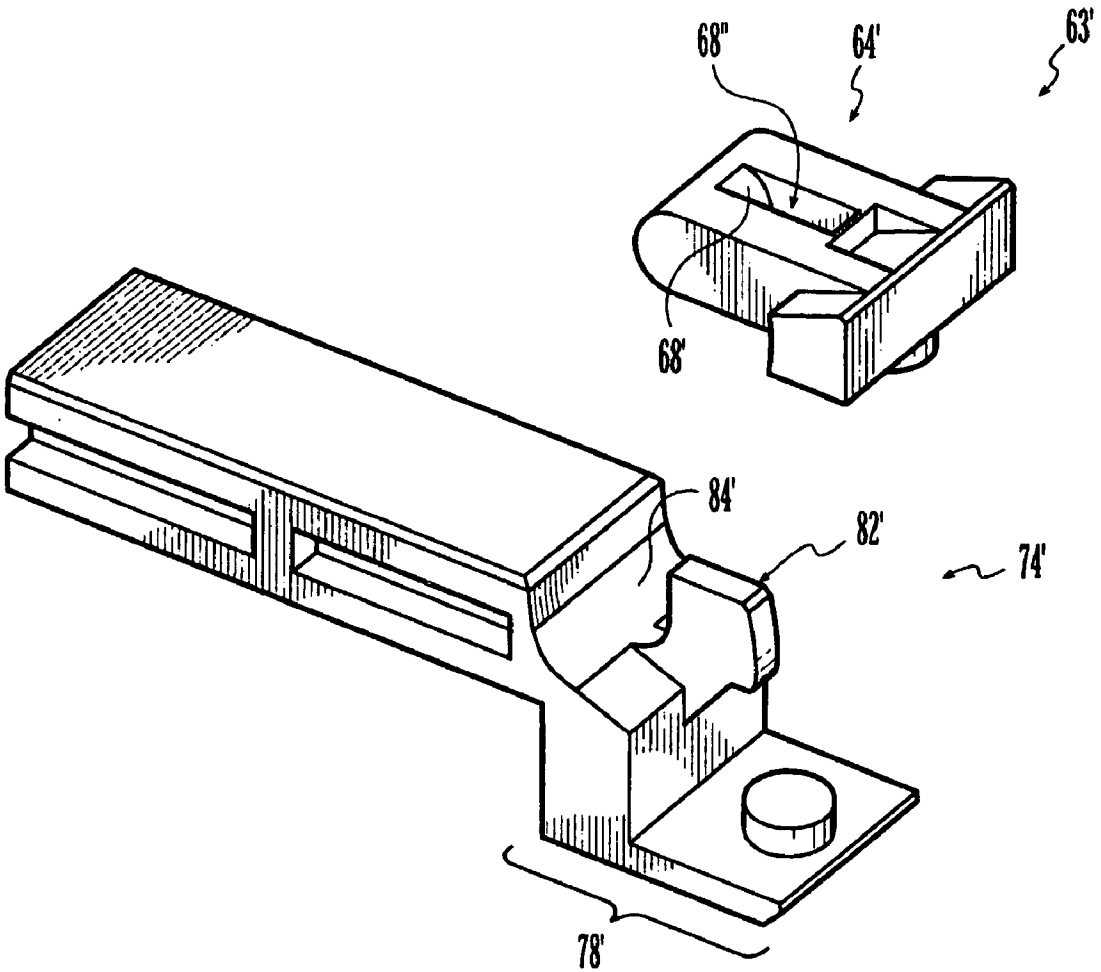
FIG. 3A is an enlarged, exploded, perspective view of another illustrative embodiment of the plunger member and a piston member for use with the lighter of FIG. 1.

Referring to FIG. 3A, a preferred embodiment of a plunger member 63' and a piston member 74' are shown for use with the lighter 2 of FIG. 1. The plunger member 63' is similar to plunger member 63 except the body portion 64' includes a single central pin portion 68' and a slot 68". The piston member 74' is similar to piston member 74 except the front portion 78' of the piston member 74' includes a single arm 82' for defining a cutout 84' for pivotally supporting the pin 68' of the plunger member 63'. When the plunger member 63' pivots downward the slot 68" receives the arm 82'.

Operation of the actuating member 25 will be discussed in detail below with reference to FIGS. 6–8. With reference to FIG. 9, according to a further aspect of the lighter 2, it may include a wand assembly 10, the details of which will now be discussed. The wand assembly 10 may be movably coupled to housing 4 and/or formed separately from housing 4. Wand assembly 10 may be pivoted between a first position or closed position, shown in FIGS. 1 and 10 and a second or open or fully-extended position, shown in FIG. 13. In the closed position, the wand assembly 10 is folded closely to housing 4 for convenient transportation and storage of lighter 2. In the fully-extended position, the wand assembly 10 extends outward and away from housing 4.

Figure 9:
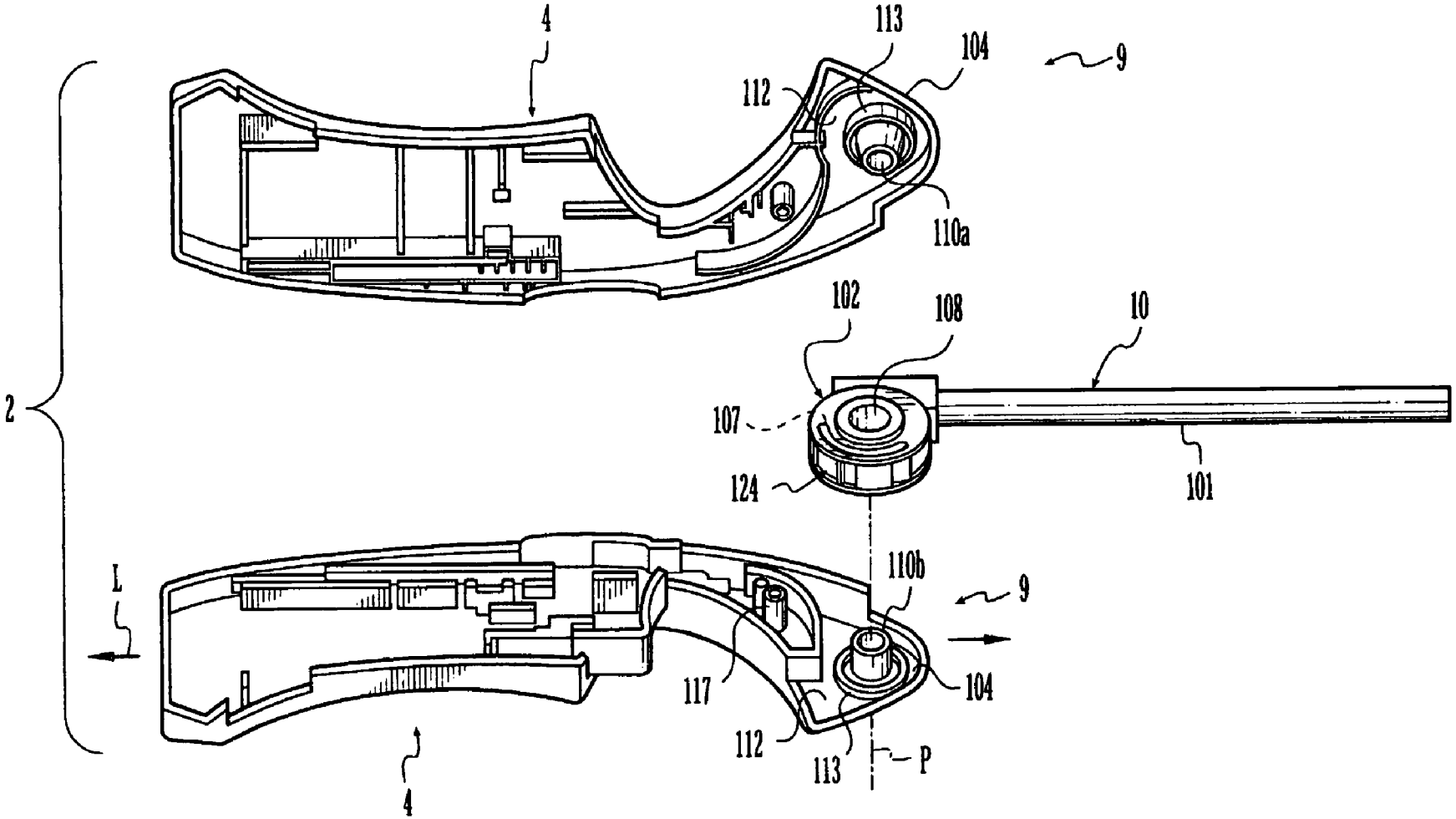
FIG. 9 is an exploded, partial, perspective view of the lighter of FIG. 1 showing the housing and the wand assembly separated.
Figure 9A:
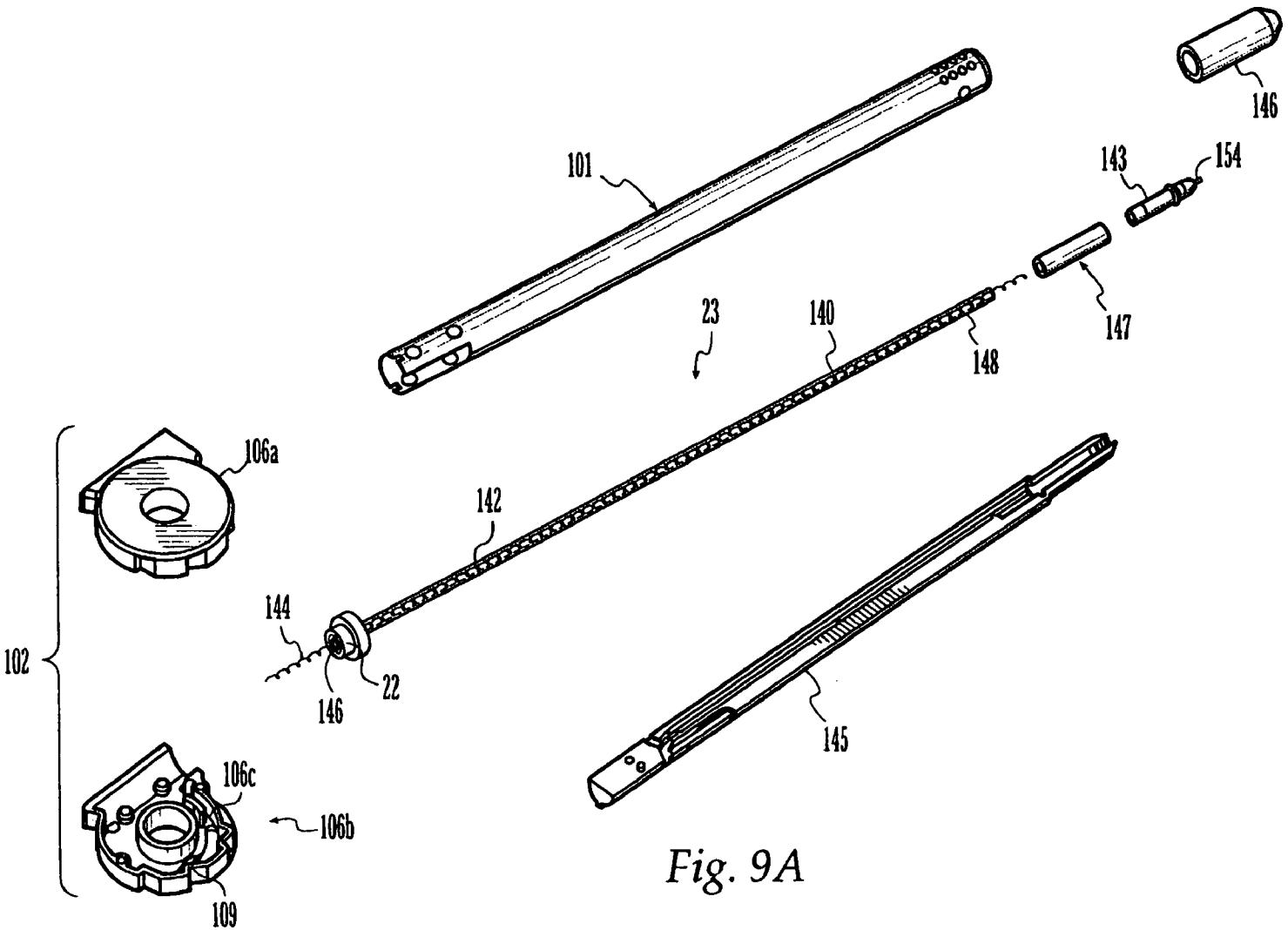
FIG. 9A is an exploded, partial, perspective view of various components of the wand assembly for use with the lighter of FIG. 1.

Referring to FIGS. 9 and 9A, wand assembly 10 includes wand 101 fixedly connected to a base member 102. The wand 101 is a cylindrical tube of metal that receives the conduit 23 (as shown in FIG. 1) and wire 28. The wand 101 also includes a tab 101*a* formed integrally therewith near the free end of the wand. Alternatively, a separate tab may be associated with wand.

Referring again to FIGS. 9 and 9A, base member 102 is receivable in a recess 104 formed in the second end 9 of housing 4. Recess 104 is located between the sides of housing 4, and therefore locates wand assembly 10 between these sides.

Base member 102 includes two body portions 106*a* and *b* and is generally cylindrical and defines a bore 108. According to the embodiment shown, body portions 106*a* and *b* define channels 106*c* so that when the body portions 106*a* and *b* are joined the channels 106*c* define a chamber 107 therein. One technique that can be used to join the base member pieces is ultrasonic welding. The present invention, however, is not limited to this configuration or construction of base member 102.

Figure 10:
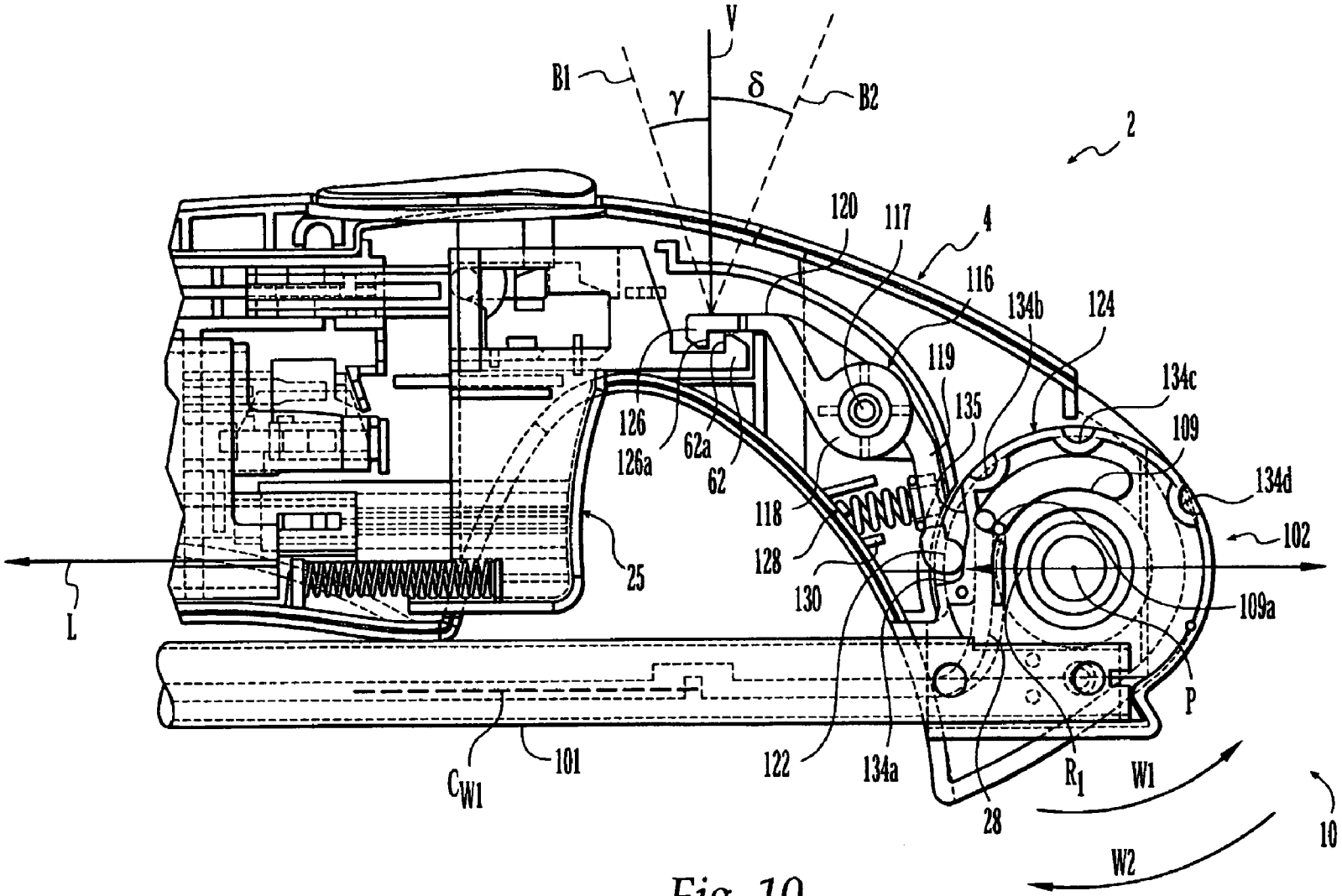
FIG. 10 is an enlarged, partial, side view of a front portion of the lighter of FIG. 1 showing the wand assembly in a closed position.

Body portion 106*b* defines an aperture 109 therein. As best seen in FIG. 10, aperture 109 is an arcuate slot that extends through body portion 106*b* and is in communication with the channel 106*c* and chamber 107 (as shown in FIG. 9) formed therein. The function of the arcuate slot 109 will be discussed in detail below.

Referring again to FIG. 9, housing 4 includes a pair of axles 110*a* and 110*b* formed on an inner surface 112 thereof. Axle 110*a* is a male member and axle 110*b* is a female member. These axles 110*a,b* may be configured and dimensioned so that they snap-fit together when joined. Alternatively, axles 110*a,b* may be joined by ultrasonic welding or other methods of joining known to one of ordinary skill in the art. In another alternative, the axles 110*a,b* may be spaced apart. Once assembled, axles 110*a* and 110*b* extend into bore 108 to pivotally couple wand assembly 10 to housing 4. Axles 110 thus define a pivot axis P about which wand assembly 10 pivots. The pivot axis P is preferably transversely extending (i.e., extends from one side of the housing 4 to the other, not vertically extending from) and is perpendicular to a longitudinal axis L, however other orientations of pivot axis P are included within the present invention. Housing 4 may also includes spacers 113 formed on the inner surface 112 of housing 4, to support base member 102 in recess 104. Base member 102 may also include a pair of optional frictional members on opposite sides thereof. For example, a pair of rubber O-rings may be seated on opposite sides of base member and rest against spacers 113. The optional frictional members may be used to provide resistance against pivoting of wand assembly 10 about pivot axis P.

Referring back to FIG. 1, the lighter housing 4 further includes a vertical wall 4*f* at the front end 9. The base member 102 further includes a projection 106*d* extending generally radially therefrom. Cooperation between the wall 4*f* and the projection 106*d* prevents movement of the wand 101 in the direction W1 substantially beyond a fully-extended position, shown in FIG. 13. Furthermore, when wand assembly 10 is in the fully-extended position, a slight clearance may exist between vertical wall 4*f* and projection 106*d* of base member 102.

Referring to FIGS. 10–14, lighter 2 may be provided with a cam member 116 that releasably positions or retains wand assembly 10 at various positions from the closed position (shown in FIG. 10) to the fully-extended position (shown FIG. 13), and at various intermediate positions (shown in FIGS. 11 and 12) there between. Cam follower 116 also may prevent a user from moving, or more specifically sliding, actuating member 25 sufficiently to ignite lighter 2 when wand assembly 10 is in the closed position of FIG. 10, and continues to prevent such sufficient movement of the actuating member 25 until wand assembly 10 has been pivoted to a predetermined position, such as a position about 40° from closed, as discussed below. Such immobilization of actuating member 25 may prevent the ignition of the lighter by preventing fuel release, or flame ignition. Flame ignition may be prevented, for example, by preventing creation of a spark.

Figure 15:
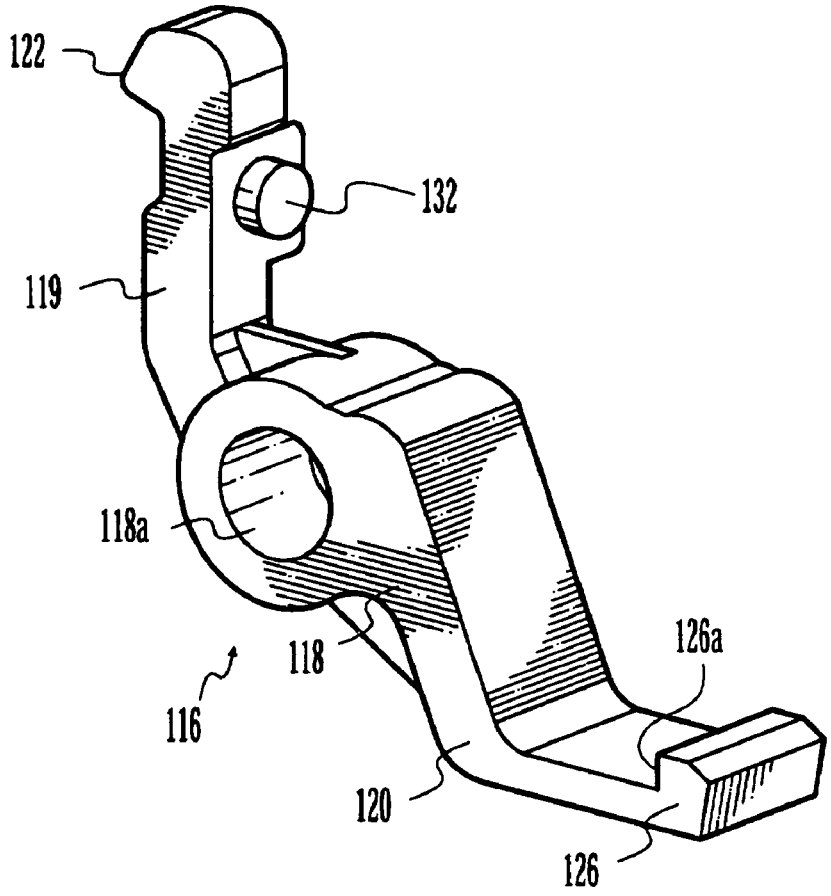
FIG. 15 is an enlarged, perspective view of a cam follower of the lighter of FIG. 1.

Referring to FIG. 15, cam follower 116 is rotatably mounted on a boss 117 (as best seen in FIG. 9) formed on housing 4. The cam follower 116 includes a hub 118 and first and second engaging portions 119, 120 extending from approximately opposite sides of the hub 118. Hub 118 includes a bore 118*a* for receiving boss 117. First portion 119 includes a follower end 122 for interacting with a camming surface 124 formed on base member 102 (see FIG. 9). Second portion 120 includes a second engaging surface 126*a* for contacting first engaging surface 62*a* (as shown in FIG. 10), which may be formed on actuating member 25. While first and second surfaces 62*a*, 126*a* are shown as portions of hooks 62, 126, other forms of engaging surfaces known to one of ordinary skill in the art are also within the scope of the present invention. Hook 126 may alternatively engage with other elements of a lighter, such as a linking member, to prevent the creation a flame.

Referring again to FIG. 10, cam follower 116 is biased counter-clockwise by a biasing member 128, shown as a compression spring, such that follower end 122 contacts and follows camming surface 124. A seat 130 is formed on housing 4 and a lug 132 (shown in FIG. 15) is formed on first portion 119, to position biasing member 128 in place. The seat 130 and lug 132 may be formed on the opposite members in an alternative embodiment. In addition, biasing member 128, although shown as a coil spring, may alternatively be a torsion spring or a leaf spring, or any other type of biasing member known to be suitable by one of ordinary skill in the art. Follower end 124 may alternatively be biased against camming surface 124 by providing a cam follower 116 with resilient properties. For example, cam follower 116 may be a resilient member that is compressed in housing 2 such that follower end 122 is resiliently biased against camming surface 124.

Camming surface 124 is an undulating surface and includes a series of first engaging portions 134*a–d*, shown as detents 134*a–d*. First engaging portions 134*a–d* may engage a follower end 122 of the first engaging portion 119. Detents 134*a–d* are shown as indentations formed in base member 102, which may receive an outward protrusion on follower end 122 such that follower end 122 is displaced radially inward causing cam follower 116 to rotate clockwise about boss 117. In the embodiment shown, the first detent 134*a* is a sloped cutout larger than the remaining detents 134*b–d*, which are concave cutouts. The detent 134*a* includes a sloped surface portion 135 to provide a low pressure angle as follower end 122 rides along camming surface 124 within the first detent 134*a*. As a result of this low pressure angle, biasing member 128 is gradually compressed as base member 102 is rotated clockwise and follower end 122 moves from the first detent 134*a* toward the second detent 134*b*, thus providing a smooth and gradual feel to the user as the wand assembly 10 is pivoted away from the closed position. This low pressure angle also reduces wear and stresses on cam follower 116 and base member 102.

The present invention is not to be limited to the shape and configuration of detents 134*a–d* shown, and detents 134*a–d* may alternatively be, for example, bumps, ridges or protrusions formed on base member 102 that engage follower end 122 and displace it radially outward, causing cam follower to rotate counter-clockwise. The present invention is also not limited to the number and location of the detents shown. Furthermore, the present invention is also not limited to the shape and configuration of cam follower 116 and ends 122 and 126. The configurations of the cam follower 116, ends 122, 126 and detents 134*a–d* may change, for example, to vary the force necessary to move the wand assembly 10. The configurations of the cam follower 116, ends 122, 126 and detents 134*a–d* may also change, for example, to vary the force necessary to hold the wand assembly in any closed or extended position including the intermediate positions.

Still referring to FIG. 10, lighter 2 is shown with wand assembly 10 in the closed position. In this position, follower end 122 is biased into first detent 134*a*, and located at a first radial distance R1 from pivot axis P. Because first detent 134*a* includes sloped surface portion 135, wand assembly 10 must be pivoted a predetermined distance, preferably about 40°, before hook 126 is disengaged from hook 62. When wand assembly 10 is in the closed position, or pivoted less than the predetermined distance, hook 126 is aligned with hook 62 of actuating member 25 such that hook walls 62*a* and 126*a* will engage upon depression of actuating member 25. Hooks 62, 126 may be spaced apart or otherwise configured so that actuating member 25 may be partially depressed, but not depressed sufficiently to ignite lighter 2, or alternatively so that actuating member 25 may not be depressed at all.

Hook walls 62*a* and 126*a* contact when hooks 62, 126 engage one another. Hook walls 62*a*, 126*a* are shown oriented substantially parallel to vertical axis V, which is perpendicular to longitudinal axis L and pivot axis P. This configuration of the hooks 62, 126 increases the force necessary to depress the actuating member 25 sufficiently to ignite the lighter.

Hook walls 62*a*, 126*a* may alternatively be angled. For example, hook walls 62*a*, 126*a* may be angled to be substantially parallel to line B1, which is angularly offset from vertical axis V by angle $\gamma$, such that hooks 62, 126 interlock. Such a configuration of the hooks would increase the force necessary to depress the actuating member 25 sufficiently to ignite the lighter. The force necessary in the interlocked configuration may be greater than the force necessary in the vertical wall configuration.

Hook walls 62*a*, 126*a* may alternatively be angled to be substantially parallel to line B2, which is angularly offset from vertical axis V by angle $\delta$. With application of a predetermined force, such hooks may deflect and disengage. Such a configuration of the hooks would increase the force necessary to depress the actuating member 25 sufficiently to ignite the lighter, but to a lesser extent than if the walls 62*a* and 126*a* were vertical or at an angle $\gamma$.

According to the embodiment shown in FIG. 10 of hooks 62 and 126, actuating member 25 may be depressed sufficiently to ignite lighter 2 when wand assembly 10 is in the closed position, however a greater amount of force will be required to do so than when wand assembly 10 is pivoted to the extended position or one of the intermediate positions therebetween due to the interaction between hooks 62 and 126. The amount of additional force required to depress actuating member 25 sufficiently to ignite lighter 2 when wand assembly 10 is in the closed position may vary, for example, by varying the angle of hook walls 62*a*, 126*a* and/or varying the materials used to form hooks 62, 126.

Wand assembly 10 provides resistance against unintentional pivoting when in the closed position, because pivoting of wand assembly 10 toward the extended position, or in first direction W1, would cause follower end 122 to ride along sloped surface 135 and compress biasing member 128. Thus, in order to pivot wand assembly 10 when wand assembly 10 is positioned in the closed position, a user must apply enough force to wand assembly 10 to cause follower end 122 to ride on sloped surface 135 and compress biasing member 128.

One of ordinary skill in the art will know and appreciate that the amount of force required may also be varied by selecting a biasing member 128 with a specific spring constant and/or modifying the geometry of camming surface 124. As a result of this feature, the wand assembly 10 is releasably retained in the closed position. Referring to FIG. 1, the lighter 2 may further include optional projections (not shown) within recess 4*f* of the housing 4 for releasably retaining the wand 101 in the closed position.

Figure 10A:
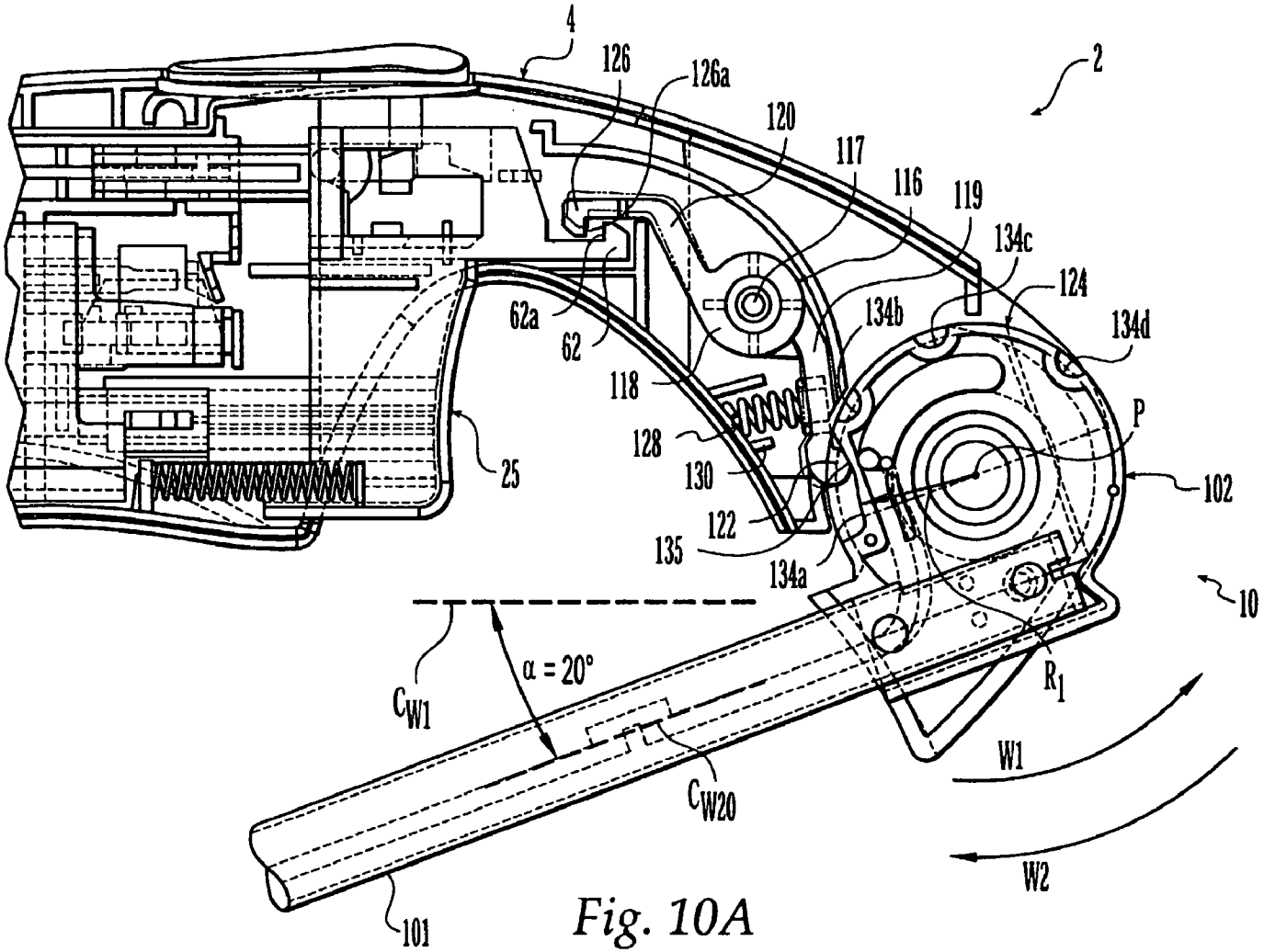
FIG. 10A is an enlarged, partial, side view of the front portion of the lighter of FIG. 10 showing the wand assembly partially-extended and pivoted by about 20°.
Figure 11:
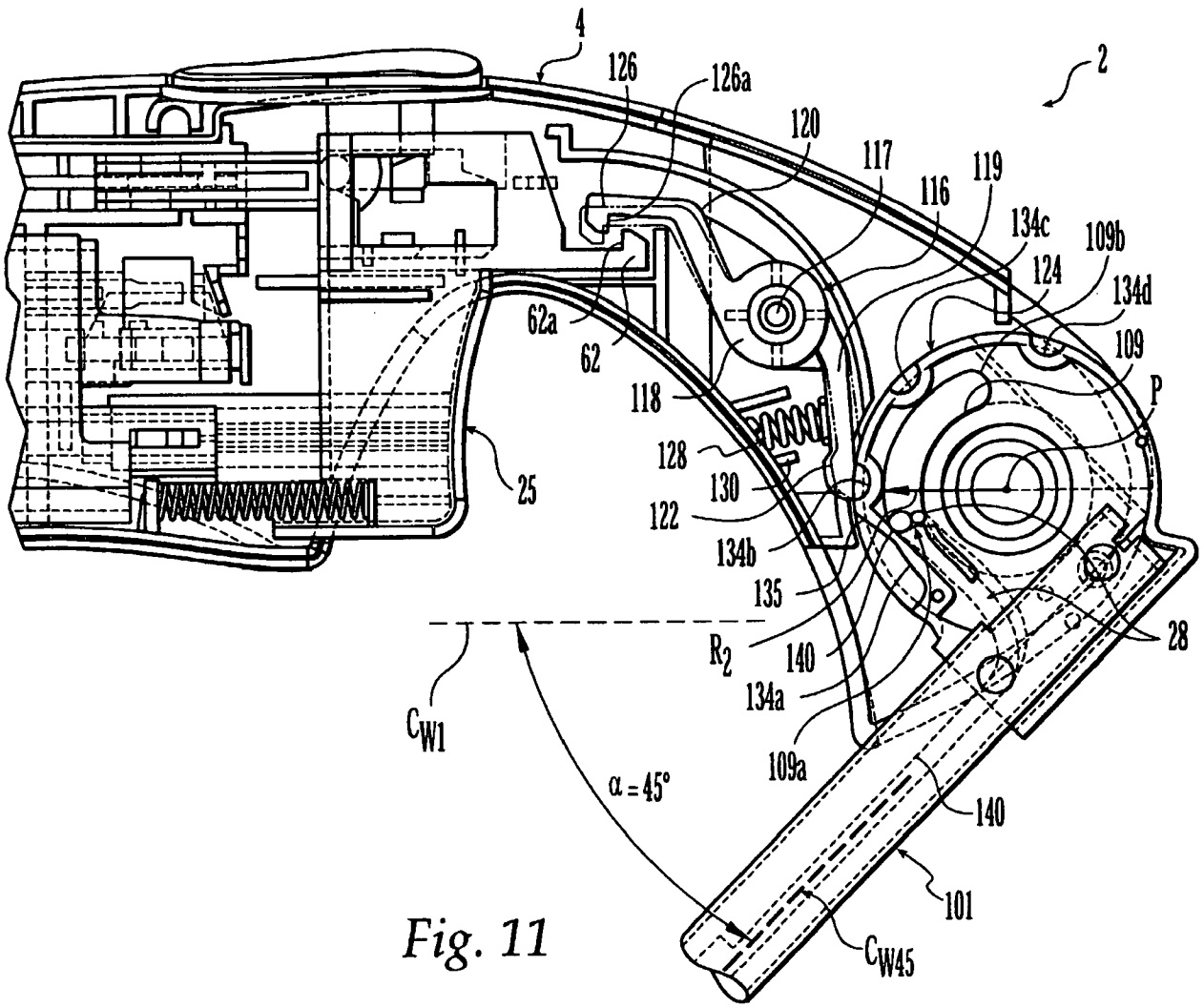
FIG. 11 is an enlarged, partial, side view of the front portion of the lighter of FIG. 10 showing the wand assembly partially-extended and pivoted by about 45°.
Figure 12:
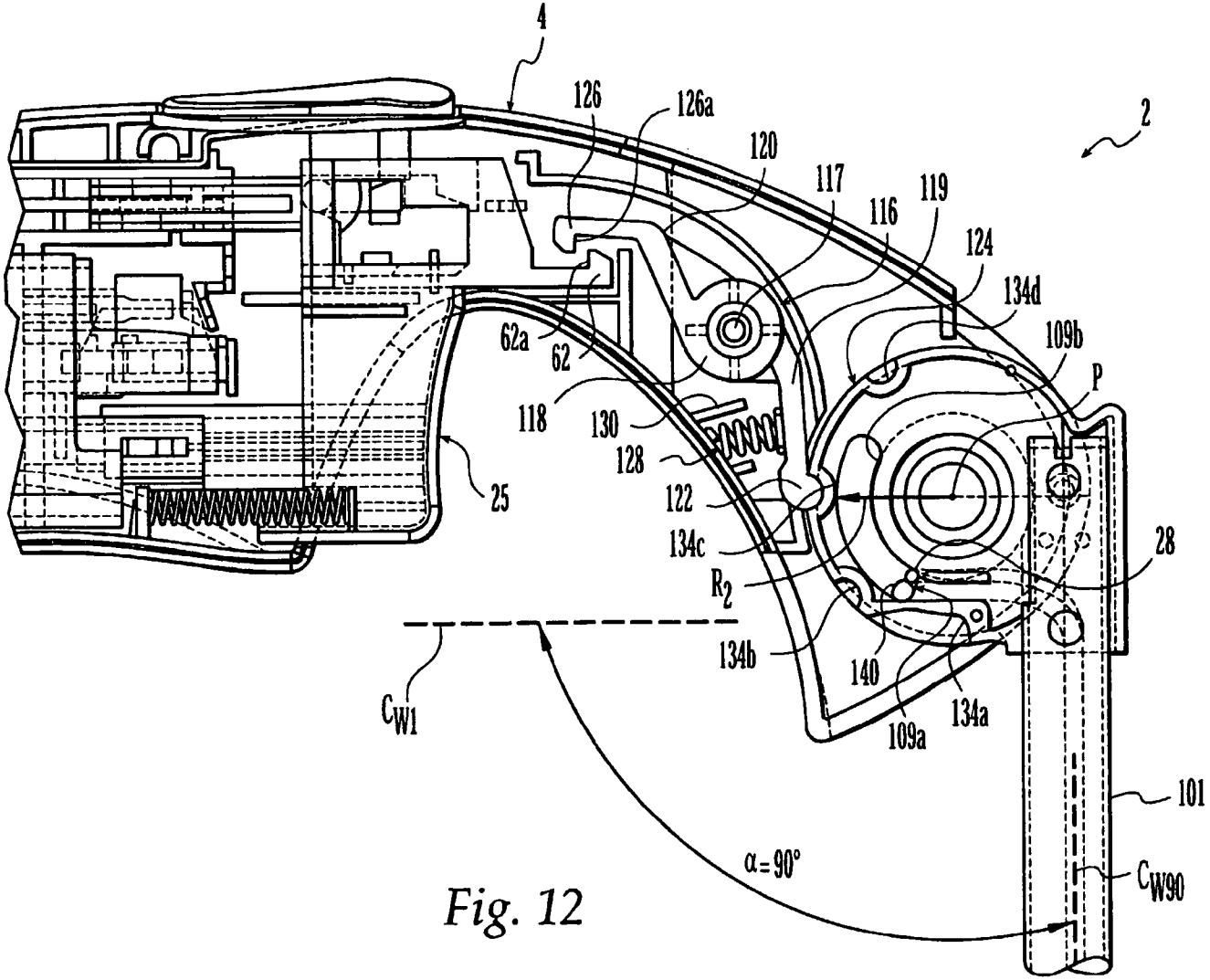
FIG. 12 is an enlarged, partial, side view of the front portion of the lighter of FIG. 10 showing the wand assembly partially-extended and pivoted by about 90°.

Referring to FIGS. 10A, 11 and 12, lighter 2 is shown with wand assembly 10 located in partially-extended or intermediate positions. In the initial position, as shown in FIG. 10, the wand assembly has a central axis CW1. In the first intermediate position, as shown in FIG. 10A, wand assembly 10 is pivoted through a pivot angle of α of about 20°. The pivot angle α is defined between the wand 101 initial central axis CW1 and the central axis CW20 of the illustrated position with the follower end 122 (as shown in phantom) in the first detent 134*a*.

In the second intermediate position, as shown in FIG. 11, wand assembly 10 is pivoted through a pivot angle of α of about 45°. The pivot angle α is defined between the wand 101 initial central axis CW1 and the central axis CW45 of the illustrated position with the follower end 122 in the second detent 134*b*.

In the third intermediate position, as shown in FIG. 12, wand assembly 10 is pivoted through a pivot angle of α of about 90°. The pivot angle α is defined between the wand 101 initial central axis CW1 and the central axis CW90 of the illustrated position with the follower end 122 in the third detent 134*c*.

Figure 14:
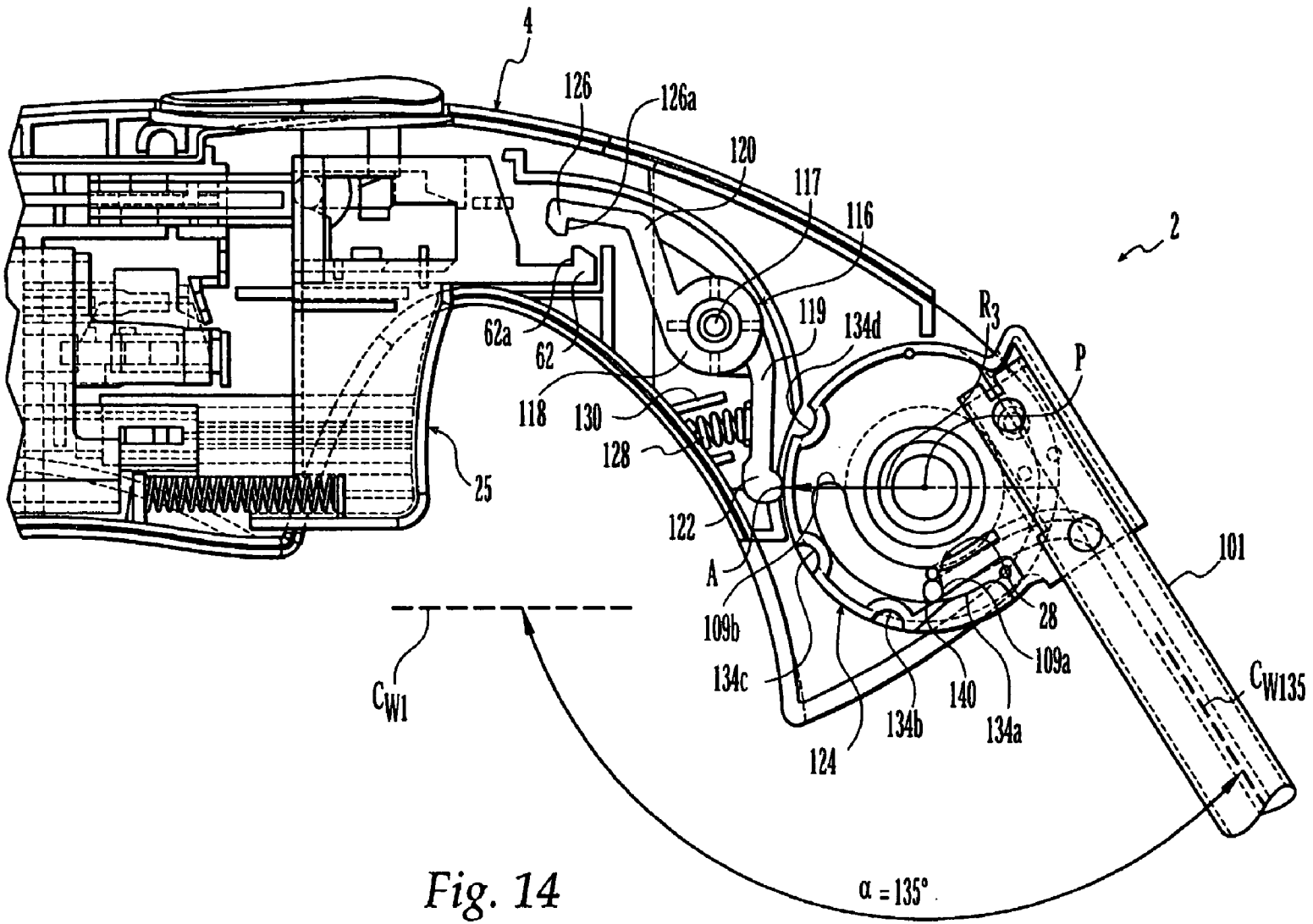
FIG. 14 is an enlarged, partial, side view of the front portion of the lighter of FIG. 10 showing the wand assembly partially-extended and pivoted by about 135°.

In the fourth intermediate position, as shown in FIG. 14, wand assembly 10 is pivoted through a pivot angle of α of about 135°. The pivot angle α is defined between the wand 101 initial central axis CW1 and the central axis CW135 of the illustrated position with the follower end 122 between the third detent 134*c* and the fourth detent 134*d*.

Figure 13:
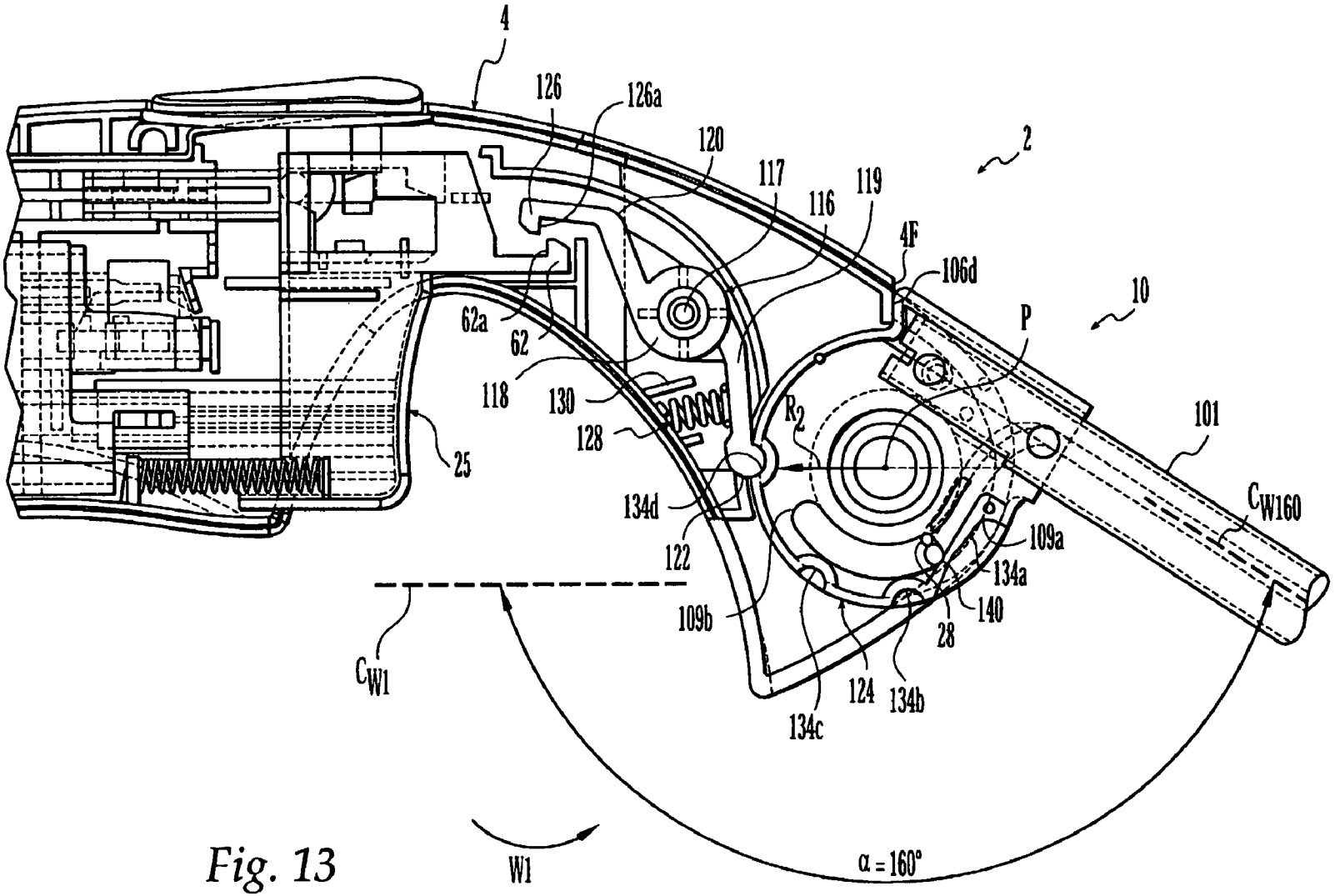
FIG. 13 is an enlarged, partial, side view of the front portion of the lighter of FIG. 10 showing the wand assembly fully-extended.

In the fully-extended position, as shown in FIG. 13, wand assembly 10 is pivoted through a pivot angle α of about 160°. The pivot angle ÿ is defined between the wand 101 initial central axis CW1 and the central axis CW160 of the illustrated position with the follower end 122 in the fourth detent 134*d*.

Referring to FIG. 10A, the cam follower 116 is shown in solid lines in its initial position, and shown in phantom lines in its radially displaced position. With the wand 101 at an angle of 20° from its initial position, follower end 122 (as shown in phantom) is in contact with sloped surface 135 within detent 134*a* and cam follower 116 is slightly rotated about boss 117, however hook 126 (as shown in phantom) and hook 62 are sufficiently aligned to engage upon depression of actuating member 25. Thus, in this position, the actuating member 25 cannot be moved sufficiently to ignite lighter 2 without applying a force greater than the force sufficient to ignite the lighter in the remaining intermediate positions (shown in FIGS. 11–12 and 14) and the closed position (shown in FIG. 13).

Referring to FIGS. 11–13, in these positions the follower end 122 is disposed within the second, third and fourth detents 134*b*, 134*c*, 134*d*, respectively, which are all located at a second radial distance R2 from pivot axis P. Second radial distance R2 is greater than first radial distance R1 (shown in FIG. 10) and, as a result, when wand assembly 10 is pivoted from the closed position, discussed above, to the intermediate and fully-extended positions, follower end 122 is displaced toward the first end 8 (shown in FIG. 1) of housing 4, causing cam follower 116 to rotate clockwise about boss 117 and rotate hook 126 out of alignment with hook 62. Thus, in these three positions, hook walls 62*a* and 126*a* will not engage upon full depression of actuating member 25. In FIG. 11, the cam follower 116 is shown in phantom lines in its initial position, and shown in solid lines in its radially displaced position. In FIGS. 12–14, the cam follower 116 is shown in its other radially displaced positions.

Wand assembly 10 exhibits variable resistance against pivoting. When wand assembly 10 is in one or more high-wand-force positions, such as, for example, the closed position (shown in FIG. 10), extended position (shown in FIG. 13), and certain intermediate positions (shown in FIGS. 11–12) between the closed and extended positions, follower end 122 contacts one of the detents 134*a*–*d*. When in any of these high-wand-force positions, pivoting of wand assembly 10 causes first portion 119 to compress biasing member 128 as follower end 122 rides along camming surface 124 and is displaced radially outward by the second, third or fourth detents, 134*b*, 134*c*, 134*d*, respectively. The force necessary for wand movement from the closed position is less that the force necessary for wand movement from the positions shown in FIGS. 11–13 since the detent 134*a* has a sloped surface portion 135. As mentioned above, a user must therefore exert sufficient force on wand assembly 10 to compress biasing member 128 and move follower 122 out of the detent, in order to pivot wand assembly 10. Lighter 2 can thus be selectively and releasably positioned or retained and stabilized at whichever of the intermediate or extended positions is most suitable. For example, the intermediate positions may be suitable for lighting jarred candles, and the fully-extended position may be suitable for lighting a barbeque grill. One of ordinary skill in the art will know and appreciate that cam surface 124 may be provided with any number of detents 134*a*–*d* spaced apart at various intervals to provide a wand assembly 10 with any number and combination of different closed, intermediate, and fully-extended positions. One of ordinary skill in the art will also know and appreciate that any number of high-force and low-wand-force positions may be located between the closed and fully-extended positions. Furthermore, the closed position may be a high-wand-force position or a low-wand-force position, and the fully-extended position may also be a high-force position or a low-wand-force position.

Referring to FIG. 14, lighter 2 is shown with wand assembly 10 in a low-wand-force position. In the low-wand-force position shown, wand assembly 10 is partially-extended and located at an angle of about 135° from the closed position. Follower end 122 is biased against camming surface 124 between the third detent 134*c* and the fourth detent 134*d* at point A, and is located at a third radial distance R3 from pivot axis. Third radial distance R3 is the nominal radius of camming surface 124 and thus, follower end 122 is located at third radial distance R3 from pivot axis P whenever follower end 122 is not aligned with one of the detents 134*a*–*d*. Third radial distance R3 is larger than first radial distance R1 and second radial distance R2, and as a result, positions follower end 122 such that hook 126 is rotated out of engagement with hook 62. Thus, when follower end 122 contacts camming surface 124 between the detents 134*a*–*d*, actuating member 25 may be depressed to ignite the lighter. As discussed above, actuating member 25 is therefore only immobilized sufficiently to prevent ignition of lighter 2 when wand assembly 10 is in or within about 40° of the closed position. In an alternative embodiment, this angle may vary.

Still referring to FIG. 14, wand assembly 10 is shown in a low-wand-force position, where follower end 122 contacts cam surface 124 between detents 134*c* and *d*. Follower end 122 is thus out of contact with detents 134*c* and *d*. In this position, less force is required to pivot wand assembly 10 than when in a high-wand-force position with follower end 122 received in detents 134*a–d*. When in a low-wand-force position, wand assembly 10 still provides some resistance against pivoting because biasing member 128 is at its maximum state of compression and therefore biases follower end 122 against camming surface 124, and creates frictional forces between follower end 122 and camming surface 124 upon pivoting of wand assembly 10. Thus, when wand assembly 10 is in a low-wand-force position, a user must only apply a low force sufficient to overcome these frictional forces in order to pivot wand assembly 10. The high-wand-force position requires more force to pivot wand assembly 10 than the low-wand-force position because the user must provide additional force to further compress biasing member 128 and move the follower 122 out of the detents 134*a–d*. The wand assembly 10 is similarly in low-wand-force positions when the follower 122 is located between detents 134*a* and *b* and detents 134*b* and *c*.

The geometry of the detents 134 and the follower end 122 may be varied to increase or decrease the amount of force required to pivot wand assembly 10 when in a high-wand-force position. For example, the detents may be relatively deep and of a size and shape that closely matches follower end 122, thus requiring a large increase in force when in a high-wand-force position. Alternatively, the detents may be relatively shallow and oversized with respect to follower end 122 to provide a small increase in force when in a high-wand-force position.

Referring to FIGS. 10 and 13, movement of the wand 101 in a second direction W2 opposite from the first direction W1 allows the wand 101 to be moved toward the closed position. The wand 101 acts as discussed above when moved toward the closed position, in that it is releasably retained in the intermediate positions (shown in FIGS. 11 and 12) during movement.

Referring again to FIG. 9A, one embodiment of a conduit 23 for use with lighter 2 of FIG. 1 is shown. Conduit 23 includes a flexible tube 140 defining a channel 142 for fluidly connecting fuel supply unit 11 to nozzle 143. Flexibly tube 140 thus transports fuel F (as shown in FIG. 1) from the fuel supply unit 11 to nozzle 143. A suitable material for flexible tube 140 is plastic. An un-insulated, electrically conductive wire 144 is disposed in channel 142, and extends from a first end 146 of tube 140 to a second end 148 of tube 140. A suitable material for electrically conductive wire 144 is copper or the like. In this embodiment, the wire 144 may be at least partially coiled. The coils may be more closely packed in some sections than other sections. In an alternative embodiment, the wire 144 may not be coiled. Fuel connector 22 is coupled to first end 146 of tube 140. Nozzle 143 is connected to second end 148 of tube 140 by nozzle connector 147. Wire 144 thus acts as an electrical conductor to pass an electrical charge to nozzle 143 to generate a spark to ignite the fuel. The wire 144 may also reinforce flexible tube 140 to provide resistance to kinking.

The conduit 23, connector 147 and nozzle 143 are supported within a pair of guide and insulator members 145, one being shown. One the pair of members 145 are positioned around these components an isolator 146 is disposed over the end of the members 145. Then the wand 101 is disposed thereon.

Figure 16:
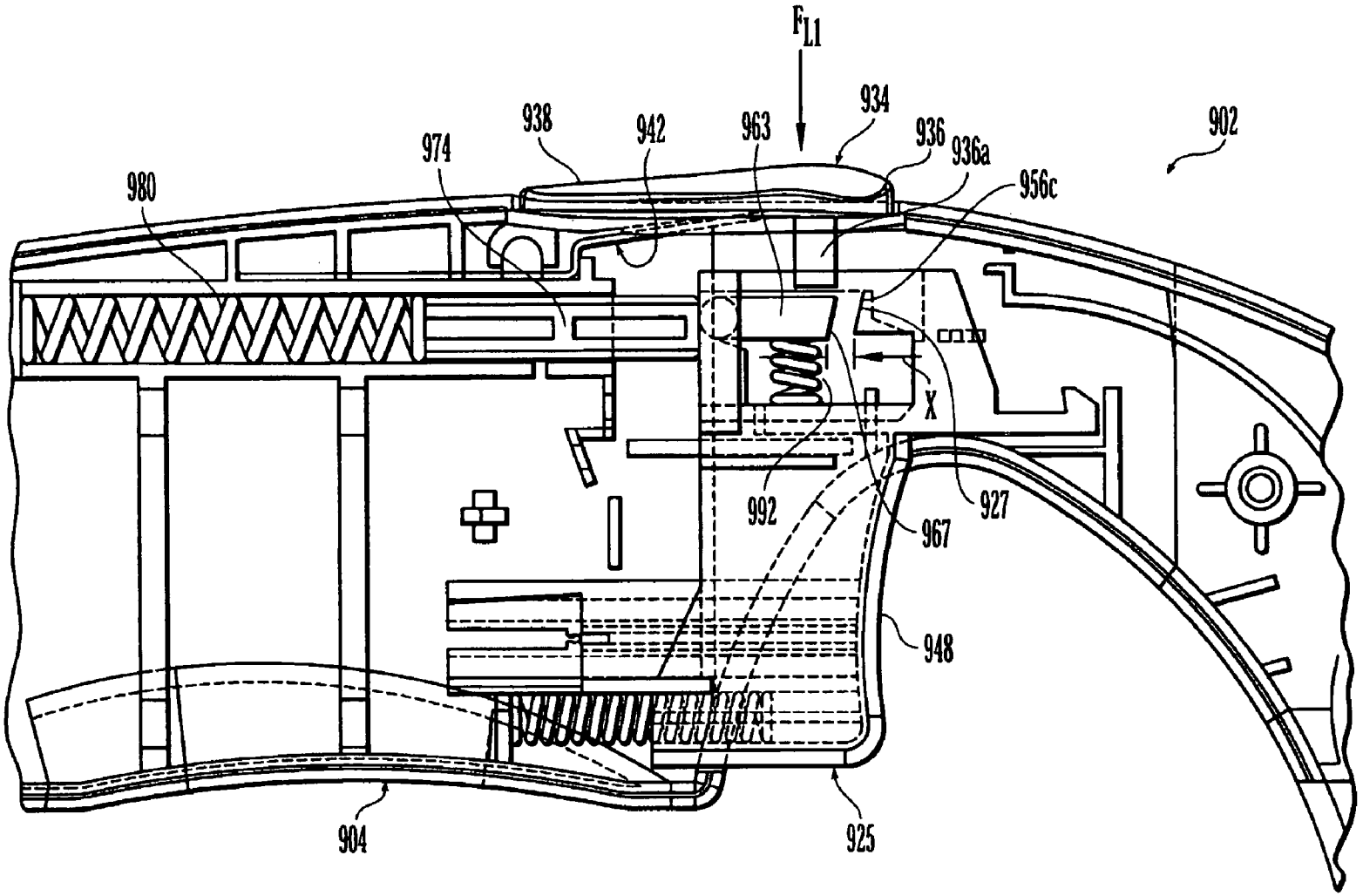
FIG. 16 is an enlarged, partial, side view of a lighter according to a second illustrative embodiment of the present invention, where the plunger member is in the high-actuation-force position and the actuating member is in an initial position.

As shown in FIGS. 1–1B and 16, the tube 140 is supported within bore 20*b* of retainer 20 and joined to fuel connector 22 so that wire 144 extends through fuel connector 22 and is in electrical contact with electrode 15*b*. The second end 148 of tube 140 is connected to nozzle 143 located adjacent the tip 152 of wand 101. Tube 140 thus conveys fuel F from the fuel supply unit 11 to the nozzle 143 at tip 152 of wand assembly 10 via channel 142. Nozzle 143 may optionally include a diffuser 154, preferably in the form of a coil spring.

Referring to FIGS. 1 and 11, conduit 23 and wire 28 run from the inside of housing 4, through at least a portion of wand assembly 10. Wire 28 is electrically connected adjacent to the end of metal wand 101 coupled to base member 102. Wire 28 may be at least partially coiled around tube 140. The conduit 23 extends to the nozzle 143. To better facilitate pivoting of wand assembly 10 with respect to housing 4, the conduit 23 and wire 28 extend through an aperture 109 in base member 102, and through the chamber 107 (as shown in FIG. 9) within base member 102. Aperture 109 is preferably spaced apart from pivot axis P. Thus, as wand assembly 10 pivots with respect to housing 4, conduit 23 and wire 28 slide within arcuate slot 109 from end 109*a* to end 109*b*. The length of conduit 23 and wire 28 also allow the wand 101 to pivot.

Once the wand assembly 10 is moved to the partially-extended or fully-extended positions, the lighter 2 may be operated in two different modes. Referring to FIG. 5, each mode is designed to resist undesired operation by unintended users in different ways. The first-operative mode or high-actuation-force mode (i.e., the high-force mode) and the second mode of operation or low-actuation-force mode (i.e., the low-force mode) are configured so that one mode or the other may be used. The high-force mode of lighter 2 provides resistance to undesirable operation of the lighter by unintended users based primarily on the physical differences, and, more particularly, the strength characteristics of unintended users versus some intended users. In this mode, a user applies a high-actuation or high-operative force to the actuating member 25 in order to operate the lighter. Optionally, the force which is necessary to operate the lighter 2 in this mode may be greater than unintended users can apply, but within the range which some intended users may apply.

The low-force mode of lighter 2 provides resistance to undesirable operation of the lighter by unintended users based more on the cognitive abilities of intended users than the high-force mode. More specifically, the second mode provides resistance due to a combination of cognitive abilities and physical differences, more particularly the size characteristics and dexterity between intended users and unintended users.

The low-force mode may rely on the user operating two components of the lighter to change the force, from the high-actuation force to the low-actuation force, which is required to be applied to the actuating member to operate the lighter. The low-force mode may rely on a user repositioning a plunger member 63 from a high-actuation-force position to a low-actuation-force position. The user may move the plunger member 63 by depressing a latch member 34. After moving the plunger member, the user may operate the lighter by applying less force to the actuating member. The low-force mode may rely on a combination of the physical and cognitive differences between intended and unintended users such as by modifying the shape, size or position of the latch member in relation to the actuating member, or alternatively, or in addition to, modifying the force and distance required to activate the latch member and the actuating member. Requiring the actuating member and latch member to be operated in a particular sequence also may be used to achieve the desired level of resistance to unintended operation.

Referring to FIG. 5, one embodiment of a lighter 2 having a high-force mode and a low-force mode will be described.

The lighter of FIGS. 3 and 5 has a movable plunger member 63, operatively associated with latch member 34.

In an initial or rest position in the high-force mode, as shown in FIG. 5, the plunger member 63, and more particularly portions 66 are disposed within portion 56*b* of cutout 56 defined in actuating member 25. The wall 66*a* of plunger member 63 contacts vertical wall 56*c* of slot 56 and is thus in a high-actuation-force position. When a user attempts to actuate actuating member 25, vertical wall 66*c* applies a force to vertical wall 66*a* which applies a force to piston member 74, which thru wall 76*a* moves to compress spring 80. Spring 80 applies a spring force FS which opposes movement of the actuating member 25. In the initial position, the spring 80 is uncompressed and has a length has a length of D1.

In this embodiment, the length D1 is substantially equal to the space between support 4*d* and piston member 74 end wall 76*a*. In another embodiment, the length D1 can be greater than this space so that the spring 80 is compressed and pre-loaded when installed or the length D1 can be less than this space.

To actuate the lighter in this high-force mode, i.e., when the portions 66 are disposed in slot portion 56*b*, a user applies at least a first actuating member force FT1 to the actuating member 25 which is substantially equal to or greater than the sum of a spring force FS, and all additional opposing forces FOP. (not shown). The spring force FS may comprise the force necessary to compress the spring 80. The opposing forces FOP may comprise the forces applied by the various other elements and assemblies which are moved and activated in order to operate the lighter, such as the spring force from the return spring 30 (see FIG. 1B) in piezoelectric unit 26, the force to compress spring 53, and the frictional forces caused by the movements of the actuating member, and any other forces due to springs and biasing members which are part of or added to the actuating member or actuating assembly, fuel container, or which are overcome to actuate the lighter. The particular forces FOP opposing operation of the lighter would depend upon the configuration and design of the lighter and thus will change from one lighter design to a different lighter design. In this mode, if the force applied to the actuating member is less than a first actuating member force FT1, ignition of the lighter does not occur.

Figure 6:
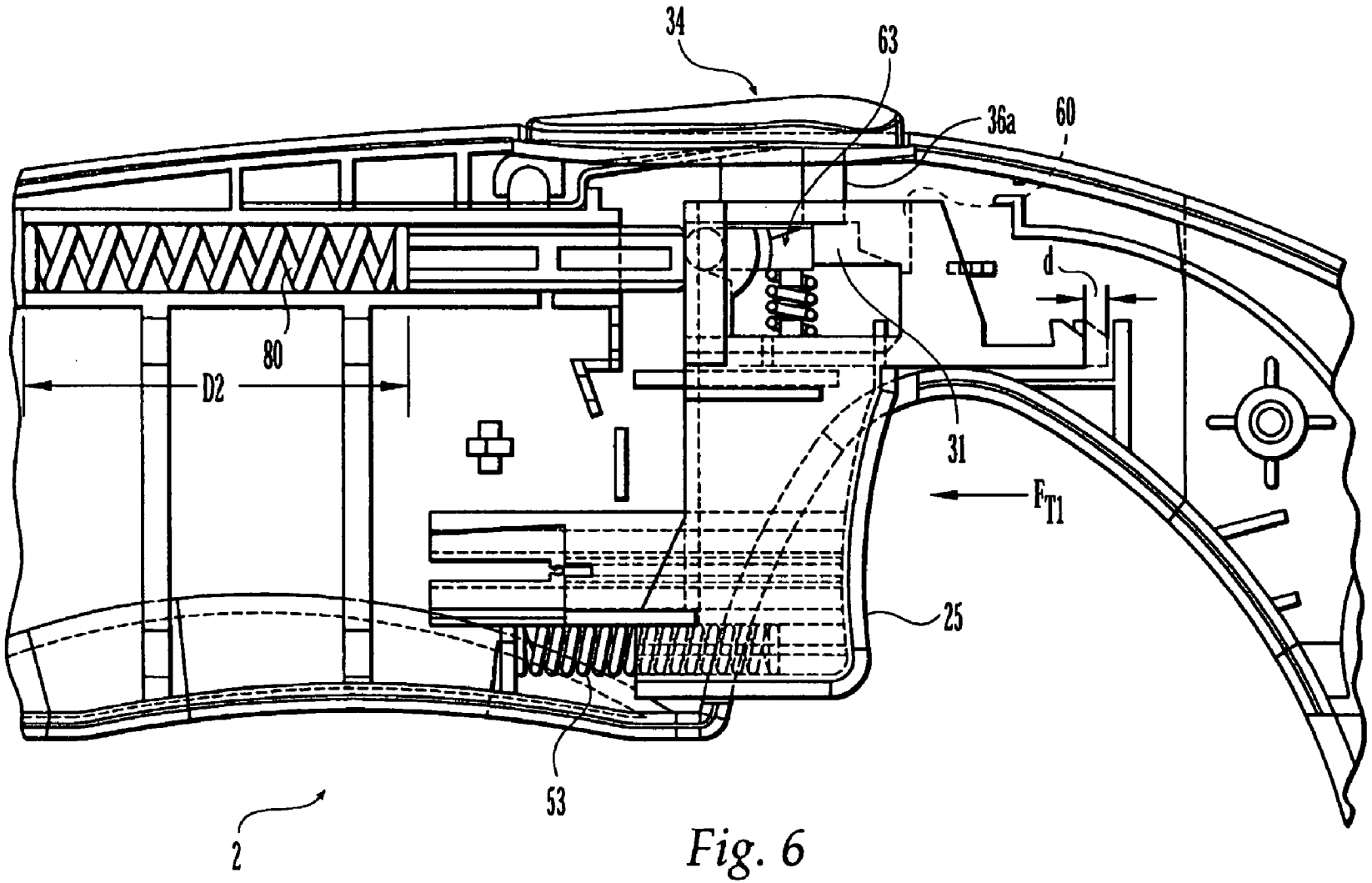
FIG. 6 is an enlarged, partial, side view of the lighter of FIG. 1, where the plunger member is in the high-actuation-force position and the actuating member is in a depressed position.

As shown in FIG. 6, when a user applies a force to the actuating member 25 at least substantially equal to or greater than the first actuating member force FT1, the actuating member 25 moves the distance d, and the plunger member 63 and piston member 74 compress spring 80. This movement of the actuating member 25, with reference to FIG. 1B, causes the upper and lower portions 26*a,b* of the piezoelectric unit 26 to compress together, thereby causing the cam member 32 on the upper portion 26*a* to move, which moves the valve actuator 14 to act on jet and valve assembly 15 to move valve stem 15*a* forward to release the fuel F from compartment 12*a*. When the cam member 32 contacts the valve actuator 14 electrical communication occurs between the piezoelectric unit 26 and the wire 144 (as shown in FIG. 9A). Further depression of the actuating member 25 causes a hammer (not shown) within the piezoelectric unit to strike a piezoelectric element (not shown), also within the piezoelectric unit. Striking the piezoelectric element or crystal, produces an electrical impulse that is conducted along wire 28 (as shown in FIG. 1) to wand 101 to the tab to create a spark gap with nozzle 143. A spark also travels from the cam member 32 to valve actuator 14, then to valve stem 15*a* and then to jet 15*a* then electrode 15*b* and wire 144 and to connector 150, and nozzle 143. An electrical arc is generated across the gap between the nozzle 143 and the wand 101, thus igniting the escaping fuel.

In the high-actuation-force mode when the actuating member 25 is depressed, the spring 80 has a length D2 (as shown in FIG. 6) less than the length D1 (as shown in FIG. 5). During this mode of operation, the latch member 34 remains substantially in the original position and boss 36*a* does not hinder actuating member 25 movement due to its location and forward movement in slot 60.

When the actuating member 25 is released, the return spring 30 (as shown in FIG. 1B) within the piezoelectric mechanism 26 and the springs 53 and 80 move or assist in moving the piston member 74, plunger member 63 and actuating member 25 into their initial, at rest, positions. Spring 16 (as shown in FIG. 1B) biases valve actuator 14 to close jet and valve assembly 15 and shut off the supply of fuel. This extinguishes the flame emitted by the lighter. As a result, upon release of the actuating member 25, the lighter automatically returns to the initial state, where the plunger member 63 remains in the high-actuation-force position (as shown in FIG. 5), which requires a high-actuation-force to actuate the actuating member.

The lighter may be designed so that a user would have to possess a predetermined strength level in order to ignite the lighter in the high-actuation-force mode. The lighter optionally may be configured so that a user may ignite the lighter in the high-actuation-force mode with a single motion or a single finger.

Figure 7:
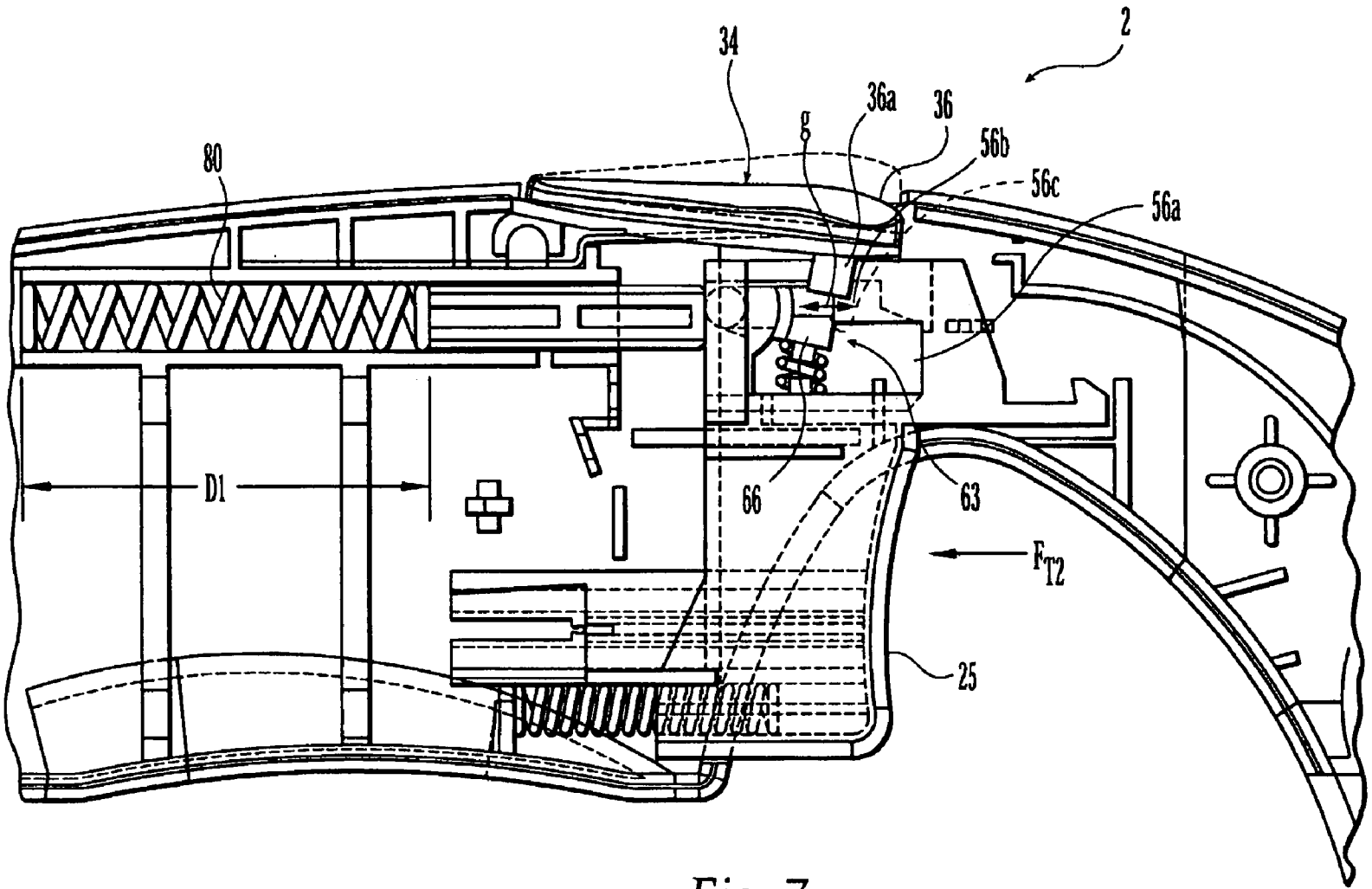
FIG. 7 is an enlarged, partial, side view of the lighter of FIG. 1, where the latch member is depressed, the plunger member is in a low-actuation-force position and the actuating member is in the initial position.

Alternatively, if the intended user does not wish to use the lighter by applying a high first actuating member force FT1 (i.e., the high-actuation-force) to the actuating member, the intended user may operate the lighter 2 in the low actuation-force mode (i.e., the low-force mode), as depicted in FIG. 7. This mode of operation comprises multiple actuation movements, and in the embodiment shown, the user applies two motions to move two components of the lighter for actuation. If the pivotal wand assembly 10 (as shown in FIG. 1) and the cam follower 116 are incorporated into the lighter, operation of the lighter in the low-actuation-force mode may include three motions, including moving the wand assembly to an extended position.

In the lighter of FIG. 7, the low-force mode includes repositioning the plunger member 63 downward such that spring 80 does not oppose motion of the actuating member 25 to the same extent as in the high-force mode. In the low-force mode, a force substantially equal to or greater than second actuating member force FT2 (i.e., a low-actuation-force) is applied to the actuating member 25 to ignite the lighter in conjunction with depressing the latch member. In this mode of operation, the second actuating member force FT2 is preferably less, and optionally significantly less, than the first actuating member force FT1.

As shown in FIG. 7, to operate the lighter 2 in the low-force mode of this embodiment includes depressing the free end 36 of the latch member 34 from the initial position (shown in phantom) toward the actuating member 25 to a depressed position. Due to the operative association between the latch member 34 and the plunger member 63, downward movement of the latch member 34 moves boss 36*a* which in turn moves front end of the plunger member 63 downward. When the latch member 34 and plunger member 63 are in their depressed positions, the recess 70 (as shown in FIG. 3) receives boss 36*a* of latch member and recess 70 provides a horizontal contact surface for the boss in this position.

The latch member may be partially or fully depressed with different results. Depending on the configuration of the lighter components, if latch member is partially depressed, the wall 66*a* may be in contact with or adjacent the vertical wall 56*c*. If the latch member 34 is depressed so that the wall 66*a* is in contact with or adjacent the vertical wall 56*c* of the actuating member 25, the lighter 2 is still in the high-force mode. If the latch member 34 is depressed so that the wall 66*a* is equal to or below wall 56*c* the lighter can slip into the low-force mode or is in the low-force mode. In some configurations, the lighter may be designed so that when the latch member 34 is fully depressed, the plunger member 63 is completely out of contact with (e.g., below) upper portion 46 (as shown in FIG. 4) of the actuating member 25.

The force applied to the actuating member in order to activate the lighter in the low-force mode, i.e., second actuating member force FT2, at least has to overcome the opposing forces FOP as discussed above to actuate the lighter. In addition, if the plunger member 63 contacts the actuating member 25, the second actuating member force must also overcome the friction forces generated by this contact during movement of the actuating member. The user, however, may not have to overcome the additional spring force Fs (as shown in FIG. 5) applied by spring 80 depending on whether the user partially or fully depresses the latch member. If partially depressed, the mode of the lighter will depend on whether vertical wall 66*a* is contacting the vertical wall 56*c* or the actuating member 25. In case the vertical wall 66*a* contacts the vertical wall 56*c*, the user may still have to overcome the high spring forces due to the extensions 66 still being within the slot portion 56*b*.

Figure 8:
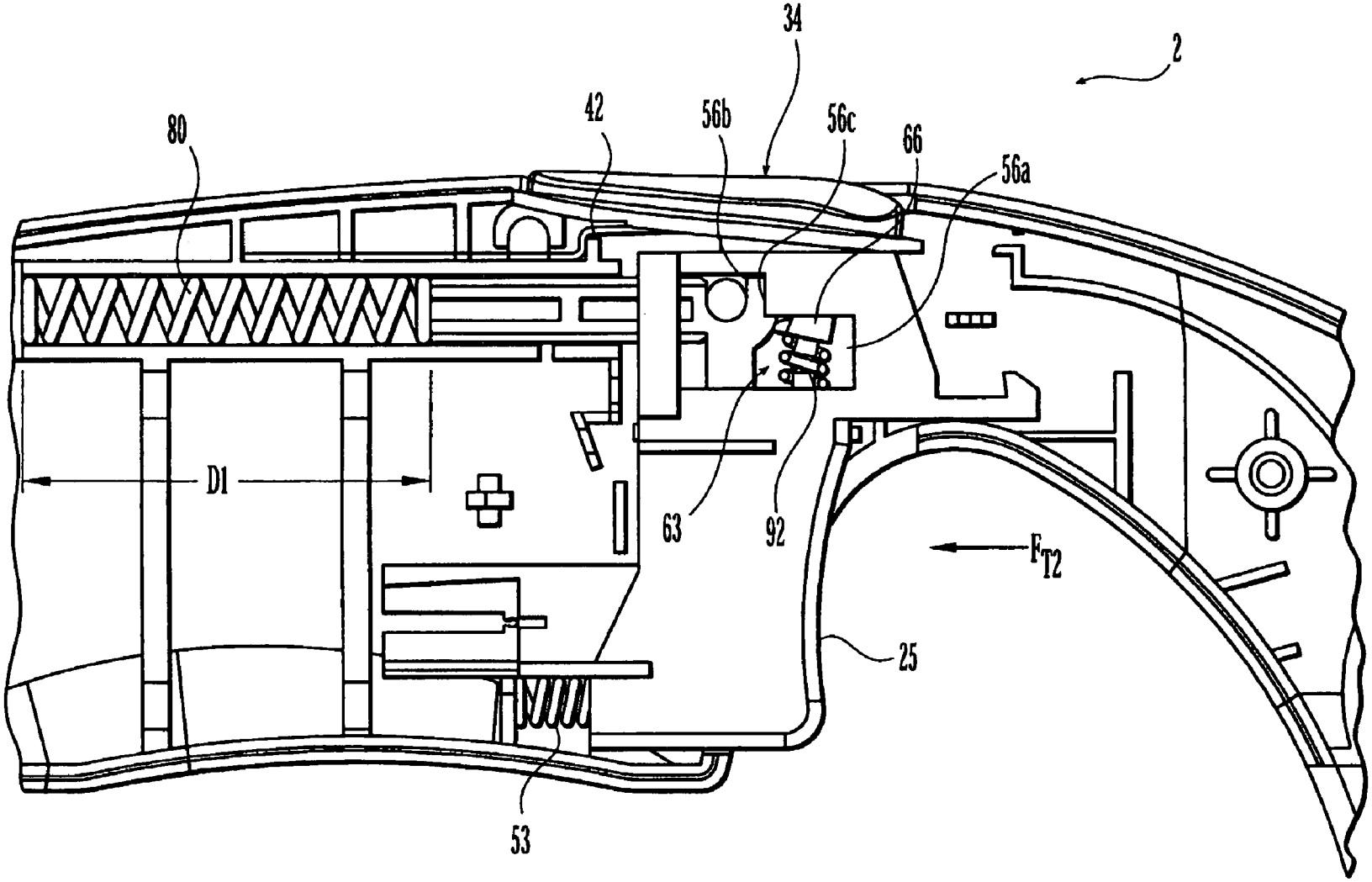
FIG. 8 is an enlarged, partial, side view of the lighter of FIG. 1, where the latch member is depressed, the plunger member is in the low-actuation-force position and the actuating member is in the depressed position.

Referring to FIG. 8, in the case of the member 63 contacts the upper surface of the slot portion 56*a* forces due to contact will have to be overcome. If fully depressed, the user may not have to overcome any spring forces since the wall 66*a* is out contact with wall 56*c*. As a result, the second actuating member force FT2 required for the low-force mode is less than the first actuating member force FT1 required for the high-force mode. If the lighter is designed so that full depression of the latch member 34 moves the plunger member 63 out of contact with the actuating member 25, the spring force Fs (shown in FIG. 5) may be substantially zero. Thus, a predetermined actuation force without forces other than the spring force Fs may be substantially zero. The user, however, will have to apply a force sufficient to overcome the other forces in the lighter to ignite the lighter.

In the low-force mode in the lighter as shown in FIG. 8, as the actuating member 25 is pressed gap g (shown in FIG. 7) decreases. In addition, as shown in FIG. 8, the spring 80 is not compressed and has its original length D1, piston 74 remains in its original position, spring 53 has been compressed and actuating member 25 moves with respect to extensions 66. This allows the lighter to be ignited in the low-force mode. When the actuating member 25 and latch member 34 are released, the spring 30 within the piezoelectric mechanism and the return spring 53 move or assist in moving the actuating member 25 into its initial position. In addition, the leaf spring 42 and spring 92 move the latch member 34 and the plunger member 63 back to their initial positions. Thus, the lighter automatically returns to the initial position, where the plunger member 63 is in a high-actuation-force position and the lighter requires a high-actuation force to operate.

Preferably, in order to perform the low-force mode, the user has to possess a predetermined level of dexterity and cognitive skills so that depression of the latch member 34 and movement of the actuating member 25 are carried out in the correct sequence. In the low-force mode, a user may use a thumb to press latch member 34 and a different finger to apply the actuating member force. The lighter may be designed so that the actuating member force preferably is applied after the latch member 34 is depressed so that a proper sequence is carried out to operate the lighter. Alternatively, another sequence can be used for actuation, and the present invention is not limited to the sequences disclosed but also includes such alternatives as contemplated by one of ordinary skill in the art. For example, the sequence can be pulling the actuating member partially, depressing the latch member, and then pulling the actuating member the rest of the way. The lighter in the low-force mode also may rely on the physical differences between intended and unintended users, for example, by controlling the spacing of the actuating member and the latch member, or adjusting the operation forces, or shape and size of the latch member, actuating member or lighter.

In order to make the lighter so that it is not excessively difficult for some intended users to actuate, the high-actuation force FT1 preferably should not be greater than a predetermined value. It is contemplated that for the lighter of FIG. 5, the preferred value for FT1 is less than about 10 kg and greater than about 5 kg, and more preferably less than about 8.5 kg and greater than about 6.5 kg. It is believed that such a range of force would not substantially negatively affect use by some intended users, and yet would provide the desired resistance to operation by unintended users. These values are exemplary and the operative force in the high-force mode may be more or less than the above ranges.

One of ordinary skill in the art can readily appreciate that various factors can increase or decrease the high-actuation force which an intended user can comfortably apply to the actuating member. These factors may include, for example, the leverage to pull or actuate the actuating member provided by the lighter design, the friction and spring coefficients of the lighter components, the actuating member configuration, the complexity of the actuating member actuation motion, the location, size and shape of the components, intended speed of activation, and the characteristics of the intended user. For example, the location and/or relationship between the actuating member and the latch member and whether the intended user has large or small hands.

The design of the internal assemblies, for example the configuration of the actuating assembly, the configuration of any linking mechanism, as discussed below, the number of springs and forces generated by the springs all affect the force which a user applies to the actuating member in order to operate the lighter. For example, the force requirements for a actuating member which moves along a linear actuation path may not equal the force requirements to move a actuating member along a non-linear actuation path. Actuation may require that a user move the actuating member along multiple paths which may make actuation more difficult. While the embodiments disclosed have shown the preferred actuating member with a linear actuation path, one of ordinary skill in the art can readily appreciate that non-linear actuation paths are contemplated by the present invention.

In the illustrated embodiment, in FIG. 7, the second actuating member force FT2 for the low-force mode is less than the first actuating member force, preferably, but not necessarily, by at least about 2 kg. Preferably in the illustrated embodiment in FIG. 7, the low-actuation force FT2 is less than about 5 kg but greater than about 1 kg, and more preferably greater than about 3.0 kg. These values are exemplary, as discussed above, and the present invention is not limited to these values as the particular desirable values will depend upon the numerous lighter design factors outlined above and the desired level of resistance to operation by unintended users.

One feature of the lighter 2 is that in the high-force mode multiple actuating operations may be performed so long as the user provides the necessary actuation force. Another feature of the lighter 2 is that in the low-force mode multiple actuating operations may be performed so long as the user depresses the latch member and provides the necessary actuation force and motions required to ignite the lighter. In particular, if the lighter does not operate on the first attempt, the user may re-attempt to produce a flame by actuating the actuating member again in the low-force mode if the user continues to depress the latch member.

Figure 16A:
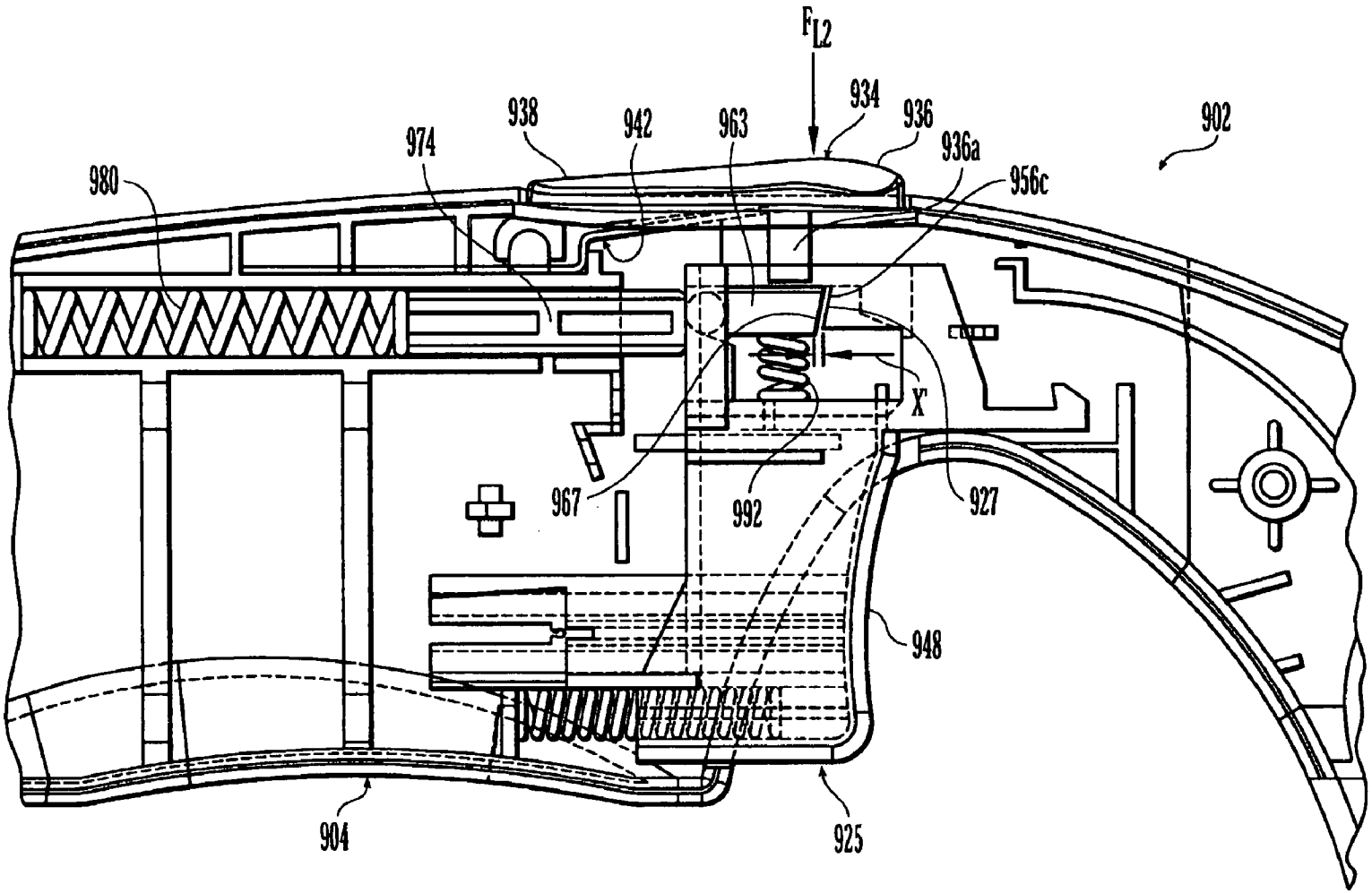
FIG. 16A is an enlarged, partial, side view of the lighter of FIG. 16, where the plunger member is in the high-actuation-force position and the actuating member is in a depressed position.

Referring to FIGS. 16 and 16A, an alternative embodiment of lighter 2 is shown. Lighter 902 is substantially similar to lighter 2, shown in FIGS. 1–4, with only the differences described herein in detail. Lighter 902 is configured and dimensioned such that the amount of force required to press latch 934 varies depending on the sequence of operation of latch 934 and actuating member 925. More specifically, the amount of force required to press latch 934 may increase if the user presses actuating member 925 before pressing latch 934. Referring to FIG. 16, lighter 902 is shown in a high-force mode with actuating member 925 in an initial position. In this mode, if a user presses latch 934 before pressing actuating member 925, a first latch force FL1 is required to press latch 934 and switch lighter 902 from the high-force mode to the low-force mode. Referring to FIG. 16A, if a user presses actuating member 925 before attempting to press latch 934, a second latch force FL2 (which may be, and preferably is, greater than first latch force FL1) is required to press latch 934 and switch lighter 902 from the high-force mode to the low-force mode. Thus, if a user attempts to press actuating member 925 while lighter 902 is in the high-force mode, and subsequently attempts to press latch 934 to switch lighter 902 to the low-force mode, latch force FL will increase and may prevent pressing of latch 934.

One illustrative example of a structure that provides this variation in latch force FL is shown in FIGS. 16 and 16A. As shown therein, a first engagement surface 967 may be associated with latch member 934, and a second engagement surface 927 may be associated with a portion of actuating member 925 (e.g., with wall 956*c*). For illustrative purposes only, first engagement surface 967 is shown as an inclined surface formed on plunger member 963, and second engagement surface 927 is shown as a matching inclined surface formed on actuating member 925, although other configurations are possible. For example, first engagement surface 967 may be formed on latch member 934 or piston member 974, and second engagement surface 927 may be formed on housing 904.

When lighter 902 is in the high-force mode and actuating member 925 is in the initial position, as shown in FIG. 16, first engagement surface 967 and second engagement surface 927 are configured such that, if a user attempts to press latch 934 to switch lighter 902 to the low-force position, the resultant movement of plunger 963 will cause substantially no engagement between the first engagement surface 967 and the second engagement surface 927. Thus, in this state, the latch force FL1 required to press latch 934 and switch lighter 902 to the low-force mode need only be sufficient to overcome the forces of spring 992, optional leaf spring 942, and any incidental frictional forces. In the lighter of FIG. 16, the first engagement surface 967 and the second engagement surface 927 are separated by a distance X, which is sufficient that latch 934 can be moved to the low-force position with first latch force FL1.

If the user presses actuating member 925 before pressing latch 934, as shown in FIG. 16A, the distance between first engagement surface 967 and second engagement surface 927 decreases (this decreased distance is indicated as X'). As a result, first engagement surface 967 may engage second engagement surface 927 when the user presses latch 934. This engagement provides resistance to pressing of latch 934 in addition to the resistance provided by spring 992, optional leaf spring 942, and any incidental frictional forces, and as a result, latch force FL2 is greater than latch force FL1. More specifically, interaction between first engagement surface 967 and second engagement surface 927 (e.g., sliding between the matching inclined surfaces) caused by pressing of latch 934, may cause plunger member 963 to move toward piston member 974 and compress spring 980. This compression of spring 980 provides additional resistance to movement of latch 934. Alternatively or additionally, interaction between first engagement surface 967 and second engagement surface 927 may cause actuating member 925 and/or latch 934 to move against the users finger, and also provide additional resistance to movement of latch 934.

One of ordinary skill in the art will know and appreciate that lighter 902 may be configured such that actuating member 925 may be partially pressed before causing first engagement surface 967 and second engagement surface 927 to engage one another (e.g., the distance X may be large enough that partial depression of actuating member 925 does not cause first engagement surface 967 to contact second engagement surface 927 upon initial pressing of latch 934). In this case, a user may move actuating member 925 a predetermined distance before pressing latch 934, and the force required to press latch 934 and switch lighter 902 to the low-force mode will remain first latch force FL1; however upon moving actuating member 925 a distance greater than the predetermined distance, the force required to press latch 934 will increase to second latch force FL2.

Figure 17:
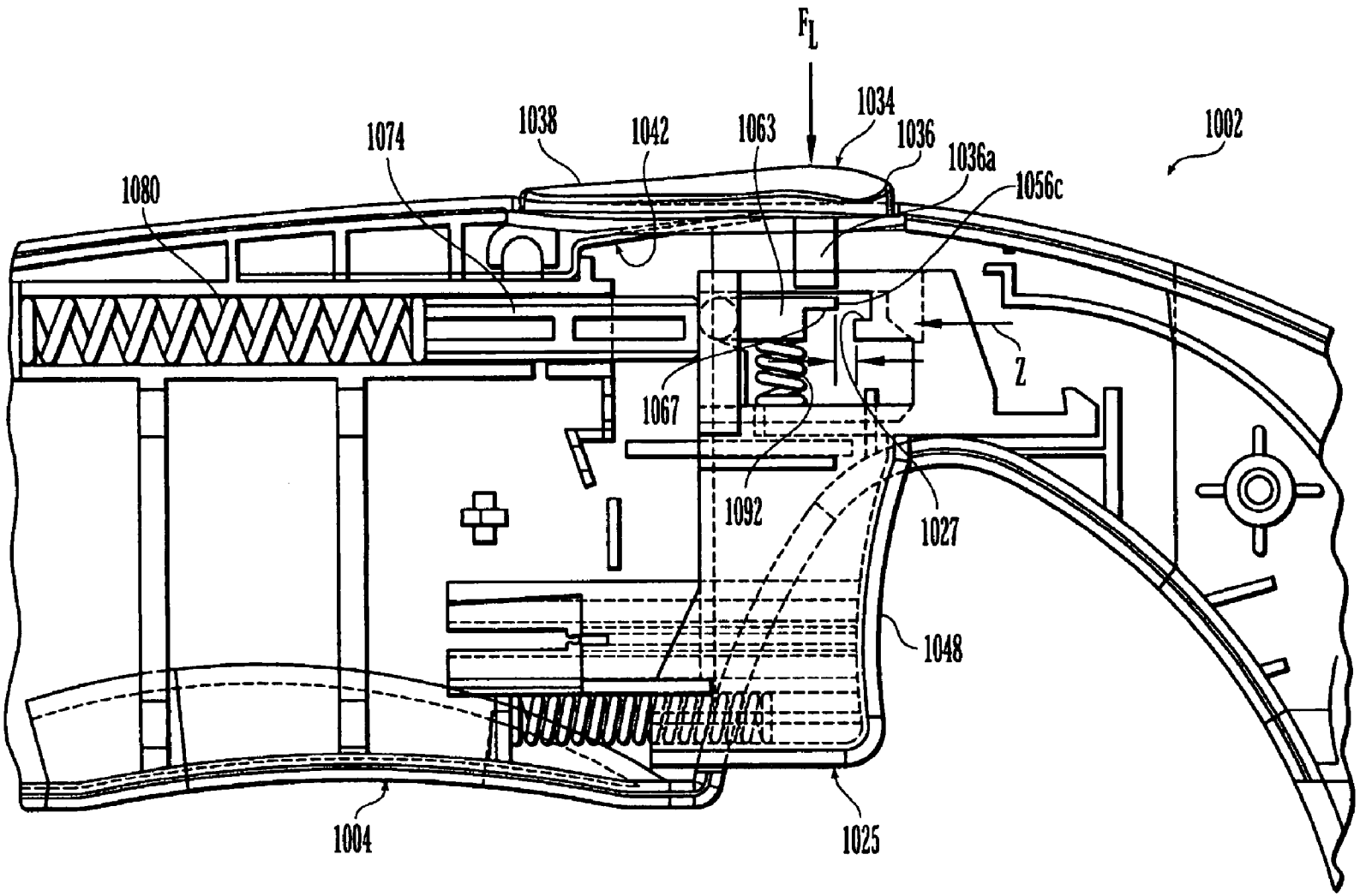
FIG. 17 is an enlarged, partial, side view of a lighter according to a third illustrative embodiment of the present invention, where the plunger member is in the high-actuation-force position and the actuating member is in an initial position.
Figure 17A:
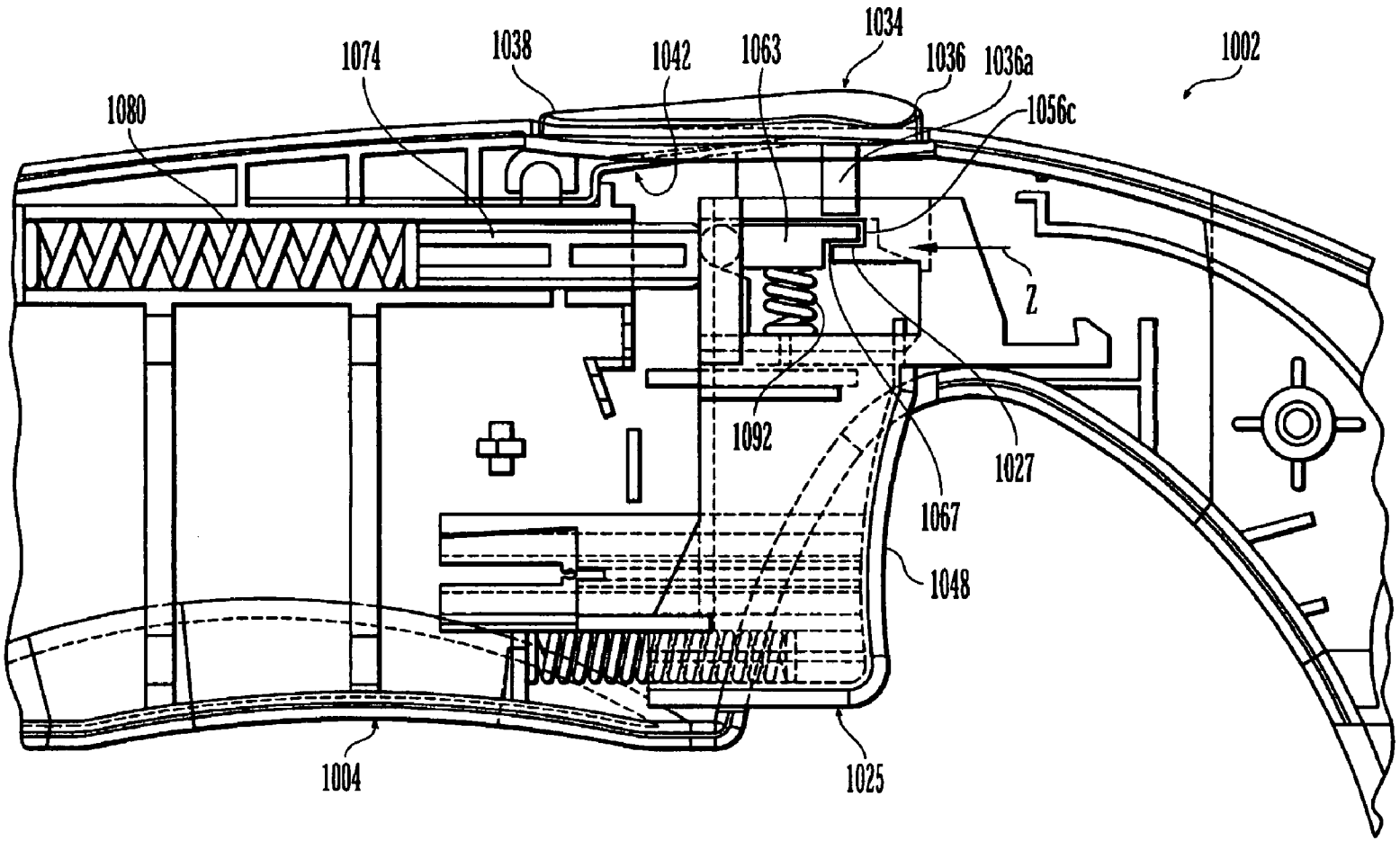
FIG. 17A is an enlarged, partial, side view of the lighter of FIG. 17, where the plunger member is in the high-actuation-force position and the actuating member is in a depressed position.

Referring to FIGS. 17 and 17A, a variation of lighter 902 is shown as lighter 1002. Lighter 1002 is substantially similar to lighter 902, except that the user may be substantially prevented from pressing latch 1034 if actuating member 1025 is pressed before pressing latch 1034. Thus, if a user presses actuating member 1025 while lighter 1002 is in the high-force mode, and subsequently attempts to press latch 1034 to switch lighter 1002 to the low-force mode, first engagement surface 1067 will engage second engagement surface 1027 to substantially prevent or block movement of latch 1034 to the low-force position. This may be accomplished by, for example, forming first engagement surface 1067 and second engagement surface 1027 as surfaces or ledges that overlap or abut when actuating member 1025 is pressed before latch 1034. As shown in FIGS. 17 and 17A, a slight gap may exist between the first and second engagement surfaces 1067, 1027, such that the first and second engagement surfaces 1067, 1027 engage only upon movement of latch 1034 a predetermined distance after movement of actuating member 1029 a predetermined distance. Alternatively, there may be substantially no gap between first and second engagement surfaces 1027, 1067 such that these surfaces are in contact prior to movement of latch 1034 a predetermined distance.

In the illustrative embodiment shown in FIGS. 17 and 17A, first and second engagement surfaces 1067, 1027 are shown substantially parallel to one another, however first and second engagement surfaces 1067, 1027 may alternatively be angled with respect to one another. Furthermore, while first and second engagement surfaces 1067, 1027 are shown as substantially horizontal surfaces (e.g., substantially parallel with respect to the direction of movement Z of actuating member 1025), they may alternatively be slightly angled surfaces (e.g., angled with respect to direction Z). In one illustrative embodiment, first engagement surface 1067 and/or second engagement surface 1027 may be angled by about 5° with respect to direction Z, however other angles are possible. One of ordinary skill in the art will appreciate that first engagement surface 1067 and second engagement surface 1027 are not limited to the configurations shown and other configurations are possible. For example, first engagement surface 1067 may be formed on piston member 1074, and second engagement surface 1027 may be formed on housing 1004. Furthermore, first engagement surface 1067 and/or second engagement surface 1027 may be hook-shaped or any other engaging shape known to one skilled in the art.

When lighter 1002 is in the high-force mode and actuating member 1025 is in the initial position, as shown in FIG. 17, first engagement surface 1067 and second engagement surface 1027 are separated by a distance Y. Distance Y is sufficient that, if a user attempts to press latch 1034 to switch lighter 1002 to the low-force position, the resultant movement of plunger 1063 will cause substantially no engagement between the first engagement surface 1067 and the second engagement surface 1027. Thus, in this state, the user may press latch 1034 to switch lighter 1002 to the low-force mode so long as a latch force FL sufficient to overcome the forces of spring 1092, optional leaf spring 1042, and any incidental frictional forces is applied.

If the user presses actuating member 1025 before pressing latch 1034, as shown in FIG. 17A, the first engagement surface 1067 overlaps the second engagement surface 1027. As a result, first engagement surface 1067 abuts second engagement surface 1027 when the user presses latch 1034. This substantially prevents or blocks pressing of latch 1034. To press latch 1034 when first engagement surface 1067 abuts second engagement surface 1027, the user would have to provide enough force to break or deform one or more components of lighter 1002. Thus, according to this embodiment, a user is substantially prevented from moving latch 1034 to the low-force mode if actuating member 1025 is pressed before latch 1034 is pressed.

One of ordinary skill in the art will know and appreciate that lighter 1002 may be configured such that actuating member 1025 may be partially pressed before causing first engagement surface 1067 and second engagement surface 1027 to engage one another. In this case, a user may move actuating member 1025 a predetermined distance before pressing latch 1034, and may still be able to press latch 1034 and switch lighter 1002 to the low-force mode; however upon moving actuating member 1025 a distance larger than the predetermined distance, the first and second engagement surfaces 1067, 1027 will engage to substantially prevent or block movement of latch 1034.

Figure 18:
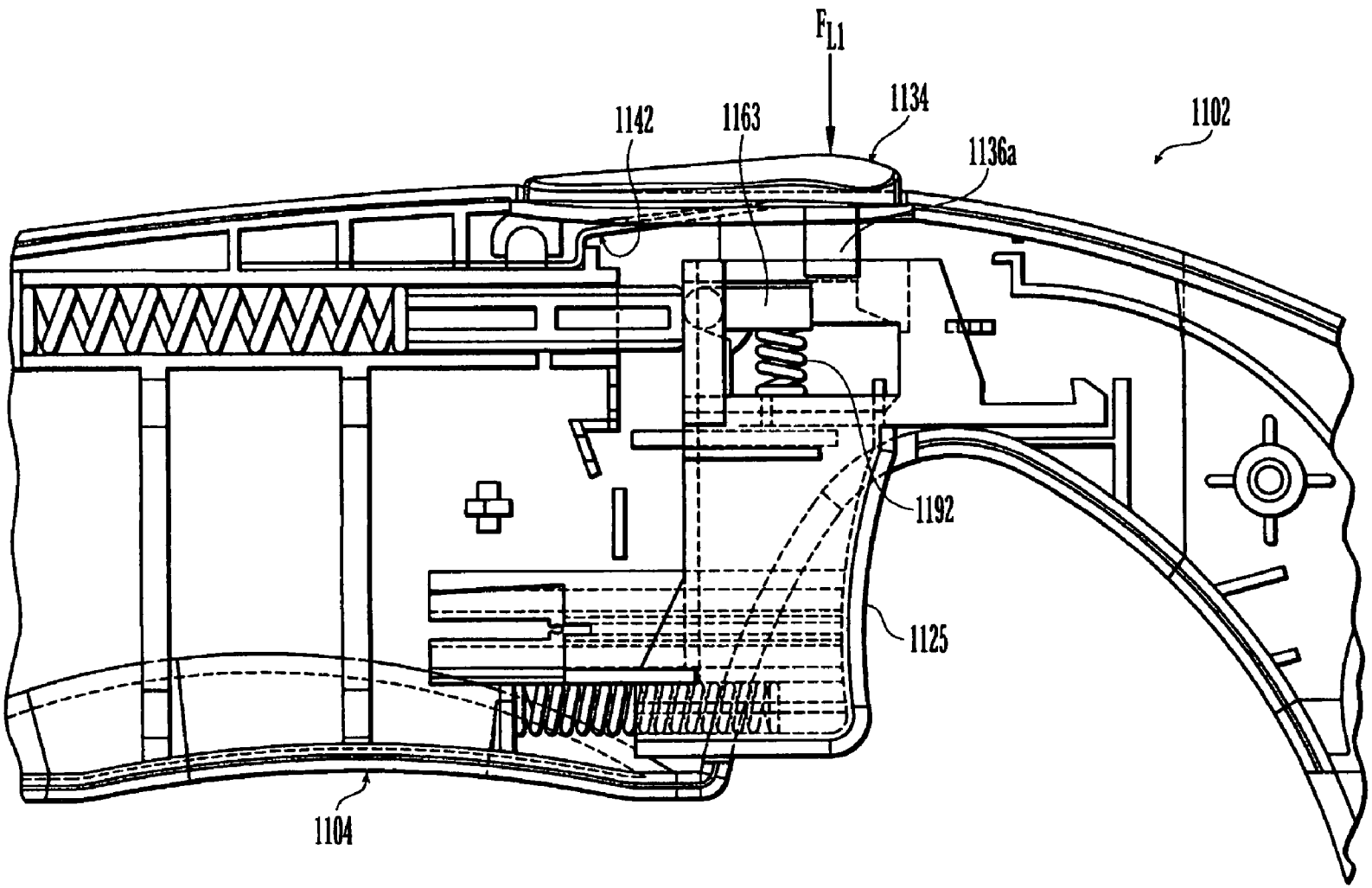
FIG. 18 is an enlarged, partial, side view of a lighter according to a fourth embodiment of the present invention, where the actuating member is in an initial position.
Figure 18A:
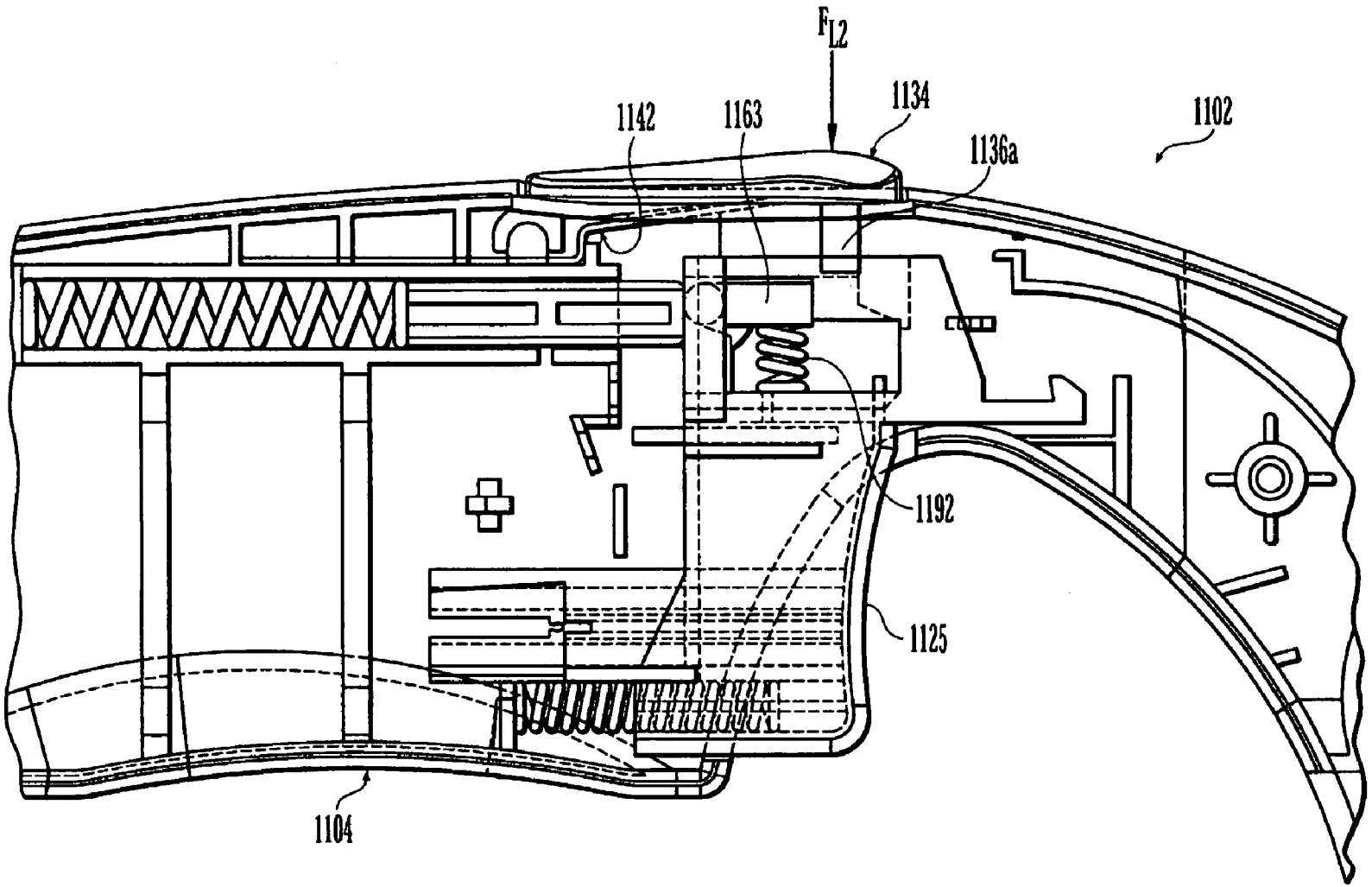
FIG. 18A is an enlarged, partial, side view of the lighter of FIG. 18, where the actuating member is in a depressed position.

Referring to FIGS. 18 and 18A, another variation of lighter 902 is shown as lighter 1102. In this embodiment, movement of actuating member 1125 a predetermined distance before movement of latch 1134 may disable the function of latch 1134 (i.e., latch 1134 may still be moved from the first latch position to the second latch position, but this movement will not effectuate the function of latch 1134 (e.g., to switch the lighter from a high-force mode to a low-force mode)). This may be accomplished, for example, by configuring latch 1134 and/or plunger 1164 such that latch 1134 becomes substantially disassociated from plunger 1164 upon movement of actuating member 1125 a predetermined distance before pressing latch 1134. More specifically, as shown in FIG. 18, when actuating member 1125 is in the initial position (i.e., non-depressed position), boss 1136*a* and plunger 1164 are at least partially aligned with one another (e.g., have a slight overlap), such that pressing latch 1134 may impart movement to plunger 1164 from the high-force position (shown) to the low-force position (not shown). In the state shown in FIG. 18, the latch force FL1 required to press latch 1134 and switch lighter 1102 to the low-force mode need only be sufficient to overcome the forces of spring 1192, optional leaf spring 1142, and any incidental frictional forces. As shown in FIG. 18A, however, when actuating member 1125 is moved a predetermined distance before pressing latch 1134, boss 1136*a* and plunger 1164 are shifted out of alignment (e.g., there is no overlap), and as a result, pressing latch 1134 will not move plunger 1164 from the high-force position to the low-force position. In the state shown in FIG. 31A, the latch force FL2 required to press latch 1134 need only be sufficient to overcome the forces of optional leaf spring 1142 and any incidental frictional forces, however, as discussed above, movement of latch 1134 will not switch lighter 1102 to the low-force mode. One of ordinary skill in the art will know and understand that lighter 1102 is not limited to the structures shown and described, and that any number of configurations may be implemented to disable the function of latch 1134 upon movement of actuating member 1125 a predetermined amount before pressing latch 1134.

One of ordinary skill in the art will recognize that lighters 902, 1002, 1102 are not limited to the structures shown and described, and that any number of structures may be implemented to vary the latch force. One of ordinary skill in the art will recognize that latch 934, 1034, 1134 is not limited to a "dual-mode" latch, as described herein, and alternatively or additionally may control other functions of the lighter.

Figure 19:
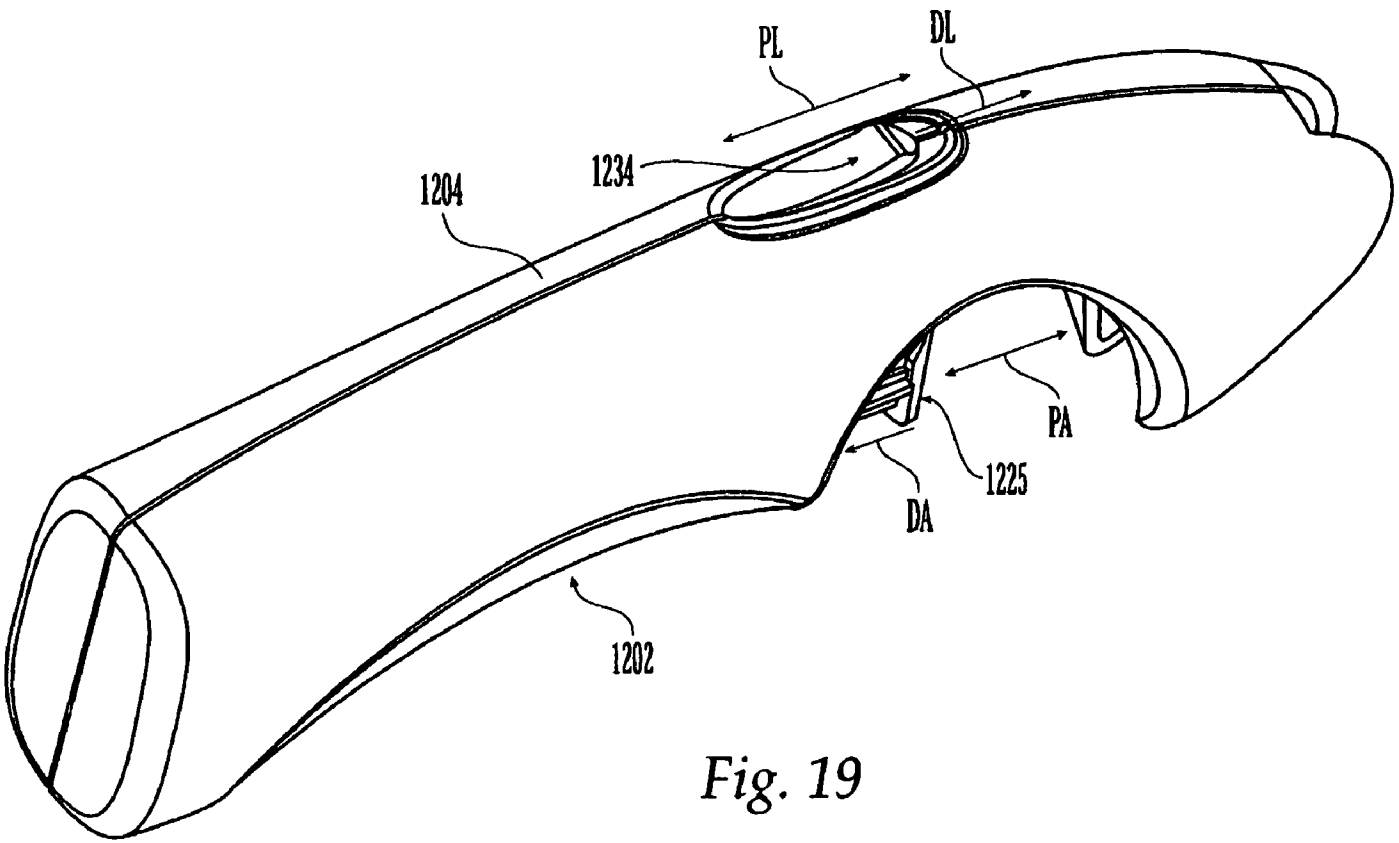
FIG. 19 is a perspective view of a lighter according to a fifth illustrative embodiment of the present invention, shown with the wand assembly removed.
Figure 20:
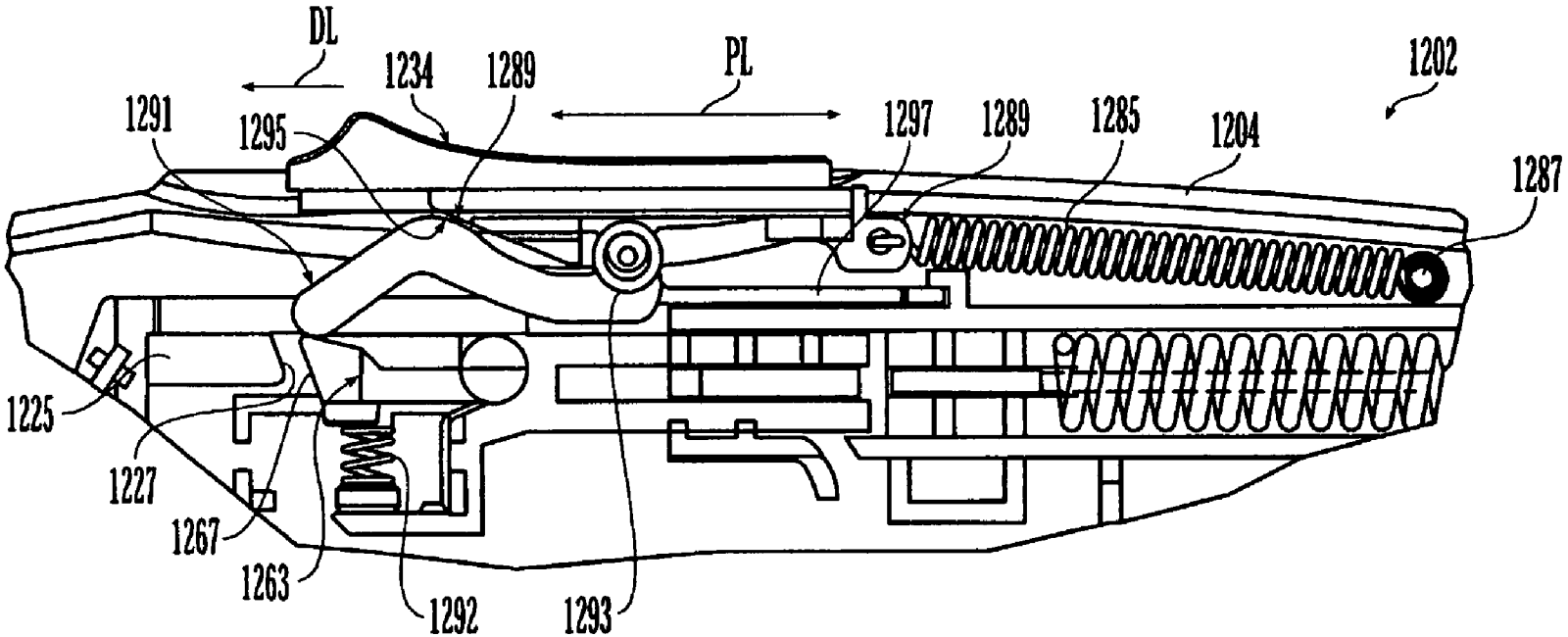
FIG. 20 is an enlarged, partial, side view of the lighter of FIG. 19, where the plunger member is in the high-actuation-force position and the latch member is in an initial position.
Figure 20A:
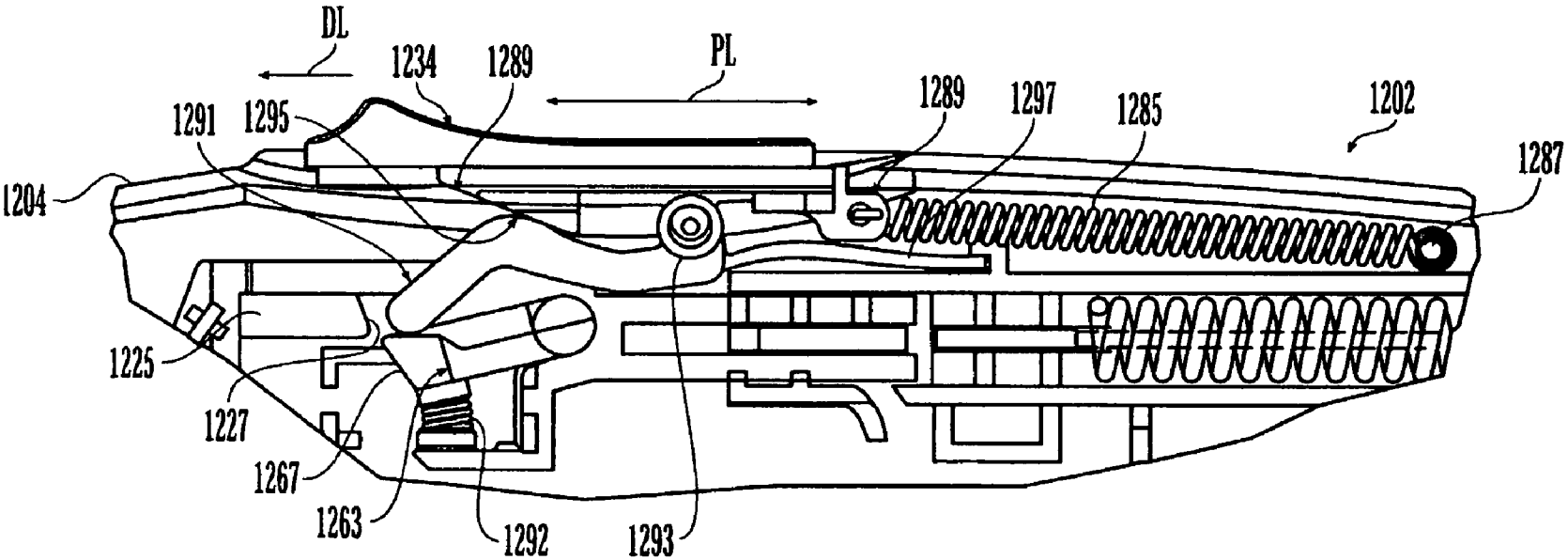
FIG. 20A is an enlarged, partial, side view of the lighter of FIG. 19, where the plunger member is in the low-actuation-force position and the latch member is in a forward position.

Referring to FIGS. 19–20A, another alternative embodiment of lighter 2 is shown. The structure and function of lighter 1202 is substantially similar to that of lighter 2, with only the differences being described herein in detail. It should be noted that lighter 1202 is shown in FIG. 19 without the wand assembly. The wand assembly for lighter 1202 may be identical or similar to the wand assembly 10 shown in FIGS. 1 and 9, although other configurations are possible. Lighter 1202 includes a latch 1234 that switches the lighter (more specifically the actuating member 1225) from a high-force mode to a low-force mode. Latch 1234 may be slidable with respect to housing 1204. For example, latch 1234 may slide along an upper surface of housing 1204. This may be accomplished by providing latch 1234 with one or more projections or extensions that slide in corresponding tracks in housing 1204, or vice versa, although one of ordinary skill in the art will know and appreciate that any number of structures are available to slidably attach latch 1234 to housing 1204. An optional elastic member 1285 (shown for illustrative purposes as a coil spring extending between a boss 1287 on housing 1204 and a receiver 1289 on latch 1234) may bias latch 1234 to a first position or free position, shown in FIG. 20, in which the actuating member 1225 is in the high-force mode. Other types and configurations of elastic members known in the art, such as elastomers, compression springs, coil springs, integrated springs, or leaf springs, may alternatively be used to bias latch 1234 to the first position.

Referring to FIG. 19, latch 1234 may move or slide along a latch path PL. Latch path PL is shown in the figures as being a along a substantially linear axis, although other configurations are possible. For example, latch path PL may be as angled, multi-axial, bent, curved, or arcuate. A user may slide the latch 1234 along latch path PL in a latch direction DL from a first, or initial position, shown in FIG. 20, to a second position, shown in FIG. 20A, to switch the actuating member 1225 from the high-force mode to the low-force mode, or vice versa. In addition, actuating member 1225 may move, and preferably slide, along an actuating member path PA in an actuating member direction DA to perform at least one step in igniting fuel to create a flame. In the illustrative embodiment shown, actuating member path PA is shown as being along a substantially linear axis, although other configurations are possible. For example, actuating member path PA my be angled, multi-axial, bent, curved or arcuate. As also shown in FIG. 19, latch path PL may be substantially parallel to actuating member path PA, although other configurations are possible. For example, latch path PL may be skewed, transverse, or perpendicular to actuating member path PA.

In the illustrative embodiment of lighter 1202 shown in FIGS. 19–20A, the lighter is configured and dimensioned for a user to use their thumb to manipulate latch 1234 while using their index finger to manipulate actuating member 1225, although other configurations are possible. As shown in FIG. 19, latch direction DL may be different from actuating member direction DA, and preferably substantially opposite actuating member direction DA. According to this configuration, a user holding lighter 1202 may be required to slide the latch 1234 in one direction (e.g., forward) with their thumb, and to pull the actuating member 1225 in an opposite direction (e.g., backward) with their index finger. Alternatively, latch direction DL may be substantially the same as actuating member direction DA, requiring a user to move the latch 1234 and the actuating member 1225 in substantially the same directions.

Referring now to FIGS. 20 and 20A, the structure and operation of the sliding latch 1234 will be described in more detail. Latch 1234 may include, or be associated with, a cam surface 1289 that interacts with a cam follower 1291 to move the plunger 1263 from a high-actuation-force position (in which actuating member 1225 (FIG. 19) is in the high-force mode) to a low-actuation-force position (in which actuating member 1225 is in the low-force mode). Cam follower 1291 may be pivotally mounted to housing 1204 or other part of lighter 1202 by a pivot axle 1293 or other structure. According to one illustrative embodiment, cam follower 1291 may have a follower surface 1295 resiliently biased against cam surface 1289. Alternatively, cam follower 1291 may float between latch 1234 and plunger 1263, such that there is no bias force on the cam follower 1291. According to the illustrative embodiments shown, an integral leaf spring 1297 may resiliently bias follower surface 1295 against cam surface 1289, although one of ordinary skill in the art will know and appreciate that any number of structures may be provided to resiliently bias follower surface 1295 against cam surface 1289. Upon sliding latch 1234 in the latch direction DL from a first, or the initial position (shown, for example, in FIG. 20) to a second or the forward position (shown, for example, in FIG. 20A), cam surface 1289 engages follower surface 1295 to pivot or rotate cam follower 1291 about pivot axle 1293. As cam follower 1291 pivots, it drives plunger 1263 from the high-actuation-force position (shown in FIG. 20) to the low-actuation-force position (shown in FIG. 20A) and in turn changes the actuating member 1225 from the high-force mode to the low-force mode. Upon releasing latch 1234, elastic element 1285 returns latch 1234 to the first position and plunger return spring 1292 returns plunger 1263 to the high-force position, which in turn returns actuating member 1225 to the high-force mode. Alternatively, the elastic element 1285 may not exist and plunger return spring 1292 may return cam follower 1291 and plunger 1263 to the high force position. One of ordinary skill in the art will recognize that cam surface 1289 and/or cam follower 1291 are optional, and that latch 1234 could alternatively be configured to act directly on plunger 1263.

Lighter 1202 may also be configured so that the amount of force required to slide latch 1234 sufficiently to change lighter 1202 from the high-force mode to the low-force mode can be varied depending on cognitive abilities or the shape, size, connective faces, and/or sequence of operation, etc., of latch 1234 and actuating member 1225. More specifically, the amount of force required to slide latch 1234 may increase if a user pulls actuating member 1225 before sliding latch 1234. For example, a first engagement surface 1267 may be associated with latch 1234, and a second engagement surface 1227 may be associated with a portion of actuating member 1225. For illustrative purposes only, first engagement surface 1267 is shown as an inclined surface formed on plunger 1263, and second engagement surface 1227 is shown as an inclined surface formed on actuating member 1225, although other configurations, surface roughness and locations of the engagement surfaces 1267, 1227 are possible. First and second engagement surfaces 1267, 1227 are configured to move past one another if a user slides latch 1234 before attempting to move actuating member 1225. The engagement surfaces 1267, 1227 are also configured to engage one another if the user attempts to move actuating member 1225 a predetermined distance without first sliding latch 1234. This engagement may resist movement of the plunger 1263 from the first position to the second position, which in turn will resist movement of the cam follower 1291 and the latch 1234. As a result, moving actuating member 1225 a predetermined distance before sliding latch 1234 increases the force necessary to slide latch 1234. Further details of this aspect of lighter 1202 are described above in connection with FIGS. 16 and 16A, and the accompanying description of lighter 902. One of ordinary skill in the art will understand that lighter 1202 may alternatively be configured such that the sequence of operation of actuating member 1225 and latch 1234 has little or no affect on the amount of force required to move or slide latch 1234.

Figure 21:
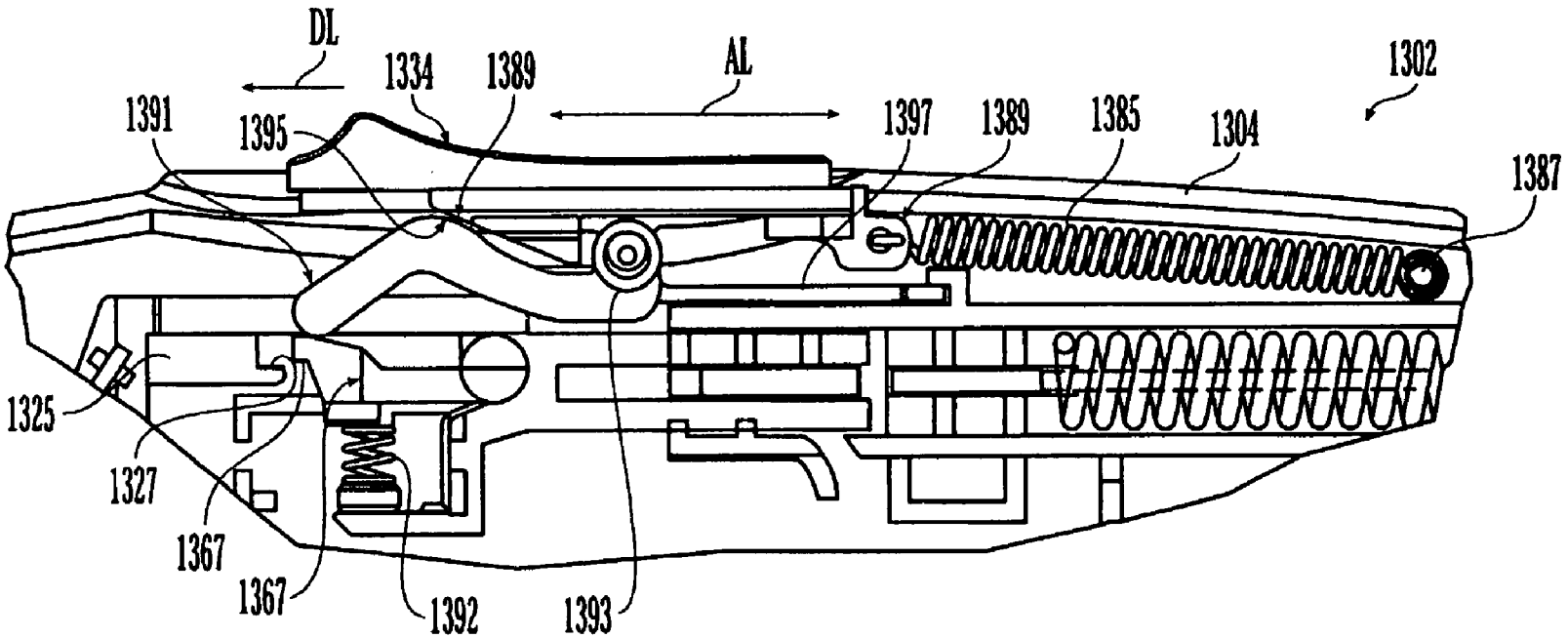
FIG. 21 is an enlarged, partial, side view of a lighter according to a sixth illustrative embodiment of the present invention, where the plunger member is in the high-actuation-force position and the latch member is in an initial position.
Figure 21A:
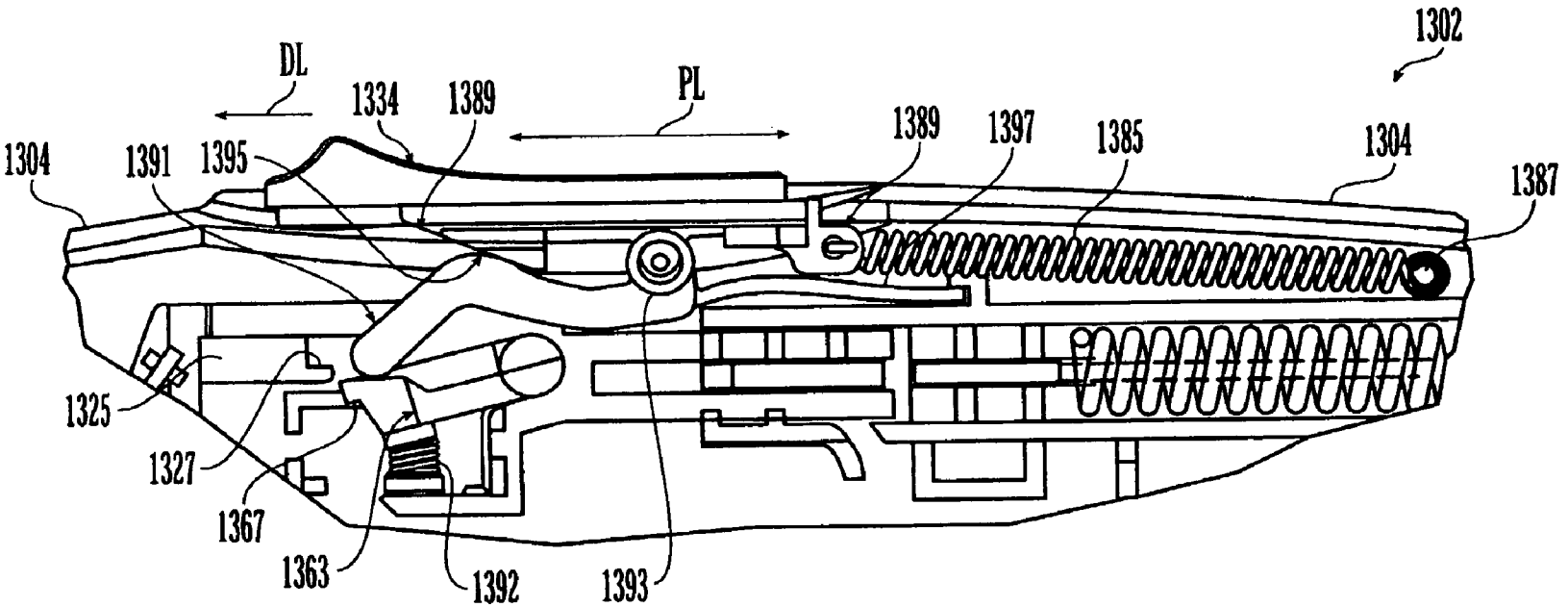
FIG. 21A is an enlarged, partial, side view of the lighter of FIG. 21, where the plunger member is in the low-actuation-force position and the latch member is in a forward position.

Referring to FIGS. 21 and 21A, a variation of lighter 1202 is shown. Lighter 1302 may be configured so that movement of actuating member 1325 (only a portion of which is shown) a predetermined distance before sliding latch 1334 substantially prevents sliding of latch 1334. This may be accomplished, for example, by forming first and second engagement surfaces 1367, 1327 as surfaces or ledges (e.g., horizontal surfaces) that overlap or abut when the actuating member 1325 is pulled a predetermined distance before latch 1334 is moved. Although other configurations, surface roughness, and locations of the engagement surface 1367, 1327 are possible. Further details of this aspect of lighter 1302 are described above in connection with FIGS. 17 and 17A, and the accompanying description of lighter 1002.

One of ordinary skill in the art will know and appreciate that lighters 2, 902, 1002, 1102, 1202 and 1302 may alternatively be configured such that the latch 34, 934, 1034, 1134, 1234, 1334 is movable between a blocking position in which the actuating member 25, 925, 1025, 1125, 1225, 1325 is substantially blocked from operative movement, and an actuating position in which the actuating member is movable to perform at least one step in igniting the fuel. This may be accomplished, for example, by substituting high-force spring 80 (shown in FIGS. 3 through 8 and described herein with respect thereto) which provides a substantial portion of the "first actuating force" with a substantially rigid member, such as a block of plastic or metal, that substantially blocks movement of the actuating member when the plunger member is in the high-actuation-force position. One of ordinary skill in the art will know and appreciate that any number of other structures and configurations can be implemented to block operative movement of actuating member unless the latch is first moved to an actuating position.

While various descriptions of the present invention are described above, it should be understood that the various features of each embodiment may be used singly or in any combination thereof. Therefore, this invention is not to be limited to only the specific embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein which are within the scope and spirit of the present invention are to be included as further embodiments of the present invention.

We claim:

1. A lighter comprising:

a housing having a supply of fuel;

an actuating member movably associated with the housing to selectively perform at least one step in igniting the fuel; and a latch member slidably associated with the housing to selectively change the actuating member from a high-force mode to a low-force mode;

wherein the actuating member is operable to perform the at least one step in igniting the fuel when in the high-force mode and the low-force mode.

2. The lighter of claim 1, wherein the latch member is slidable along a surface of the housing.

3. The lighter of claim 1, wherein the actuating member is movable in a first direction to perform the at least one step in igniting the fuel and the latch member is slidable in a second direction to selectively change the actuating member from the high-force mode to the low-force mode.

4. The lighter of claim 3, wherein the first direction is different than the second direction.

5. The lighter of claim 3, wherein the first direction is substantially opposite the second direction.

6. The lighter of claim 3, wherein the first direction is substantially the same as the second direction.

7. The lighter of claim 1, wherein the actuating member is movable along a first path and the latch member is slidable along a second path.

8. The lighter of claim 7, wherein the first path is substantially parallel to the second path.

9. The lighter of claim 7, wherein the first path is transverse to the second path.

10. The lighter of claim 7, wherein at least one of the first and second paths is substantially linear.

11. The lighter of claim 7, wherein at least one of the first and second paths is angled or multi-axial.

12. The lighter of claim 7, wherein at least one of the first and second paths is curved or arcuate.

13. The lighter of claim 1, further comprising a cam follower, wherein the latch member includes a cam surface that interacts with the cam follower to change the actuating member from the high-force mode to the low-force mode.

14. The lighter of claim 13, wherein the cam follower pivots.

15. The lighter of claim 14, wherein the cam follower is pivotally mounted to the housing.

16. The lighter of claim 13, further comprising a plunger member movable between a first position where the actuator member is in the high-force mode and a second position where the actuator member is in the low-force mode, wherein the cam follower moves the plunger member from the first position to the second position.

17. The lighter of claim 16, wherein the plunger member is normally located in the first position and the latch member is normally located in an initial position, and sliding the latch member a predetermined distance out of the initial position causes the cam follower to move the plunger member to the second position.

18. The lighter of claim 1, wherein moving the actuating member a predetermined distance before sliding the latch member increases the amount of force necessary to slide the latch member.

19. The lighter of claim 18, further comprising a first engagement surface associated with the latch member and a second engagement surface associated with the actuating member, wherein the first engagement surface engages the second engagement surface upon movement of the actuating member a predetermined distance before sliding the latch member.

20. The lighter of claim 19, further comprising a plunger member, wherein the first engagement surface is formed on the plunger member and the second engagement surface is formed on the actuating member, wherein the first and second engagement surfaces are substantially inclined.

21. The lighter of claim 1, wherein moving the actuating member a predetermined distance before sliding the latch member substantially prevents sliding of the latch member a sufficient distance to change the actuating member from the high-force mode to the low-force mode.

22. The lighter of claim 21, further comprising a first engagement surface associated with the latch member and a second engagement surface associated with the actuating member, wherein the first engagement surface engages the second engagement surface upon movement of the actuating member a predetermined distance before sliding the latch member.

23. The lighter of claim 22, further comprising a plunger member, wherein the first engagement surface is formed on the plunger member and the second engagement surface is formed on the actuating member, wherein the first and second engagement surfaces are substantially horizontal.

24. The lighter of claim 22, further comprising a plunger member, wherein the first engagement surface is formed on the plunger member and the second engagement surface is formed on the actuating member, wherein the first and second engagement surfaces are substantially vertical.

25. The lighter of claim 1, wherein when the actuating member is in the high-force mode, a first actuating force is required to move the actuating member to perform the at least one step in igniting the fuel, and when the actuating member is in the low-force mode, a second actuating force is required to move the actuating member to perform the at least one step in igniting the fuel, wherein the first actuating force is greater than the second actuating force.

26. The lighter of claim 25, wherein the first actuating force is less than about 10 kg.

27. The lighter of claim 1, wherein the at least one step in igniting the fuel is releasing the fuel or creating a spark.

28. The lighter of claim 1, wherein the actuating member selectively releases the fuel and creates a spark.

29. The lighter of claim 1, wherein the lighter is a utility lighter having a wand extending from the housing.

30. The lighter of claim 29, wherein the wand is pivotable with respect to the housing.

31. The lighter of claim 1, wherein the actuating member is configured to be operable by a user's index finger and the latch member is configured to be operable by a user's thumb.

32. A lighter comprising:

a housing having a supply of fuel;

an actuating member associated with the housing and movable along a first path in a first direction to selectively perform at least one step in igniting the fuel; and a latch member associated with the housing and movable along a second path in a second direction from a first position where the actuating member is in a high-force mode to a second position where the actuating member is in a low-force mode;

wherein the first path is substantially parallel to the second path.

33. The lighter of claim 32, wherein the first direction is substantially different than the second direction.

34. The lighter of claim 32, wherein the first direction is substantially opposite the second direction.

35. The lighter of claim 32, wherein at least one of the first and second paths is substantially linear.

36. The lighter of claim 32, wherein at least one of the first and second paths is curved or arcuate.

37. The lighter of claim 32, wherein at least one of the first and second paths is angled or multi-axial.

38. The lighter of claim 32, wherein when the actuating member is in the high-force mode, a first actuating force is required to move the actuating member to perform the at least one step in igniting the fuel, and when the actuating member is in the low-force mode, a second actuating force is required to move the actuating member to perform the at least one step in igniting the fuel, wherein the first actuating force is greater than the second actuating force.

39. The lighter of claim 38, wherein the first actuating force is less than about 10 kg.

40. The lighter of claim 32, wherein the latch member is slidable with respect to the housing.

41. The lighter of claim 40, wherein the latch member slides along a surface of the housing.

42. The lighter of claim 32, further comprising a cam follower for interaction with the latch member.

43. The lighter of claim 42, wherein the cam follower is pivotally associated with the housing.

44. The lighter of claim 42, further comprising a plunger member movable between a first position where the actuator member is in the high-force mode and a second position where the actuator member is in the low-force mode, wherein the cam follower moves the plunger member from the first position to the second position.

45. The lighter of claim 32, wherein moving the actuating member a predetermined distance before moving the latch member increases the amount of force necessary to slide the latch member.

46. The lighter of claim 45, further comprising a first engagement surface associated with the latch member and a second engagement surface associated with the actuating member, wherein the first engagement surface engages the second engagement surface upon movement of the actuating member a predetermined distance before sliding the latch member.

47. The lighter of claim 46, further comprising a plunger member, wherein the first engagement surface is formed on the plunger member and the second engagement surface is formed on the actuating member, wherein the first and second engagement surfaces are inclined.

48. The lighter of claim 32, wherein moving the actuating member a predetermined distance before moving the latch member substantially prevents movement of the latch member a sufficient distance to change the actuating member from the high-force mode to the low-force mode.

49. The lighter of claim 48, further comprising a first engagement surface associated with the latch member and a second engagement surface associated with the actuating member, wherein the first engagement surface engages the second engagement surface upon movement of the actuating member a predetermined distance before sliding the latch member.

50. The lighter of claim 49, further comprising a plunger member, wherein the first engagement surface is formed on the plunger member and the second engagement surface is formed on the actuating member, wherein the first and second engagement surfaces are substantially horizontal.

51. The lighter of claim 49, further comprising a plunger member, wherein the first engagement surface is formed on the plunger member and the second engagement surface is formed on the actuating member, wherein the first and second engagement surfaces are substantially vertical.

52. The lighter of claim 32, wherein the at least one step in igniting the fuel is releasing the fuel or creating a spark.

53. The lighter of claim 32, wherein the actuating member selectively releases the fuel and creates a spark.

54. The lighter of claim 32, further comprising a wand extending from the housing.

55. The lighter of claim 52, wherein the wand is pivotable with respect to the housing.

56. The lighter of claim 32, wherein the actuating member is configured to be operable by a user's index finger and the latch member is configured to be operable by a user's thumb.

57. A lighter comprising:

a housing having a supply of fuel;

an actuating member movably associated with the housing to selectively ignite the fuel; and a latch member associated with the housing for selectively changing the actuating member from a high-force mode to a low-force mode;

wherein the actuating member is movable along a first path in a first direction to perform at least one step in igniting the fuel, the latch member is movable along a second path in a second direction to change the actuating member from the high-force mode to the low-force mode, and the first direction is substantially opposite the second direction.

58. The lighter of claim 57, wherein the latch member is slidable along a surface of the housing.

59. The lighter of claim 57, wherein the actuating member is configured to be operable by a user's index finger and the latch member is configured to be operable by a user's thumb.

60. The lighter of claim 57, wherein the first path is substantially parallel to the second path.

61. The lighter of claim 57, wherein the first path is transverse to the second path.

62. The lighter of claim 57, wherein at least one of the first and second paths is substantially linear.

63. The lighter of claim 57, wherein at least one of the first and second paths is curved or arcuate.

64. The lighter of claim 57, wherein at least one of the first and second paths is angled or multi-axial.

65. The lighter of claim 57, further comprising a cam follower, wherein the latch member includes a cam surface that interacts with the cam follower to change the actuating member from the high-force mode to the low-force mode.

66. The lighter of claim 65, further comprising a plunger member movable between a first position where the actuator member is in the high-force mode and a second position where the actuator member is in the low-force mode, wherein the cam follower moves the plunger member from the first position to the second position.

67. The lighter of claim 66, wherein the plunger is normally located in the first position and the latch member is normally located in an initial position, and moving the latch member a predetermined distance out of the initial position causes the cam follower to move the plunger member to the second position.

68. The lighter of claim 57, wherein moving the actuating member a predetermined distance before moving the latch member increases the amount of force necessary to slide the latch member.

69. The lighter of claim 57, wherein moving the actuating member a predetermined distance before moving the latch member substantially prevents movement of the latch member a sufficient distance to change the actuating member from the high-force mode to the low-force mode.

70. The lighter of claim 57, wherein when the actuating member is in the high-force mode, a first actuating force is required to move the actuating member to perform the at least one step in igniting the fuel, and when the actuating member is in the low-force mode, a second actuating force is required to move the actuating member to perform the at least one step in igniting the fuel, wherein the first actuating force is greater than the second actuating force.

71. The lighter of claim 70, wherein the first actuating force is less than about 10 kg.

72. The lighter of claim 57, wherein the lighter is a utility lighter having a wand extending from the housing.

73. The lighter of claim 72, wherein the wand is pivotable with respect to the housing.

74. A lighter comprising:

a housing having a supply of fuel;

an actuating member associated with the housing and movable along a first path to selectively perform at least one step in igniting the fuel; and a latch member associated with the housing and movable along a second path from a first position where the actuating member is in a high-force mode to a second position where the actuating member is in a low-force mode;

wherein the first path is substantially parallel to the second path.

75. A lighter comprising:

a housing having a supply of fuel;

an actuating member movably associated with the housing to selectively perform at least one step in igniting the fuel; and a latch member associated with the housing for selectively changing the actuating member from a high-force mode to a low-force mode;

wherein the actuating member is movable in a first direction to perform at least one step in igniting the fuel, the latch member is movable in a second direction to change the actuating member from the high-force mode to the low-force mode, and the first direction is substantially opposite the second direction.

* * * * *